US006913022B2

(12) United States Patent
Moser et al.

(10) Patent No.: US 6,913,022 B2
(45) Date of Patent: Jul. 5, 2005

(54) DEVICE FOR FILLING A CIGARETTE TUBE WITH A METERED AMOUNT OF TOBACCO

(75) Inventors: Larry E. Moser, Marysville, IN (US); Robert J. Daily, New Albany, IN (US)

(73) Assignee: Cousins Distributing, Inc., Suisun, CA (US)

( * ) Notice: Subject to any disclaimer, the term of this patent is extended or adjusted under 35 U.S.C. 154(b) by 0 days.

(21) Appl. No.: 10/714,359

(22) Filed: Nov. 14, 2003

(65) Prior Publication Data

US 2004/0099277 A1 May 27, 2004

Related U.S. Application Data

(60) Provisional application No. 60/428,199, filed on Nov. 21, 2002.

(51) Int. Cl.[7] ..... A24C 5/02
(52) U.S. Cl. ..... 131/70; 131/71; 131/72
(58) Field of Search ..... 131/70–72

(56) References Cited

U.S. PATENT DOCUMENTS

| | | | | |
|---|---|---|---|---|
| 2,551,095 | A | * 5/1951 | Chaze | 222/162 |
| 3,699,975 | A | 10/1972 | Saraber | |
| 4,167,091 | A | 9/1979 | Ruppert et al. | |
| 4,167,948 | A | 9/1979 | Moscovitch | |
| 4,180,082 | A | 12/1979 | Wachter | |
| 4,184,591 | A | 1/1980 | Geldmacher | |
| 4,215,705 | A | 8/1980 | Marcil | |
| 4,249,546 | A | 2/1981 | Heil et al. | |
| 4,303,082 | A | 12/1981 | Thompson et al. | |
| 4,319,588 | A | 3/1982 | Evans | |
| 4,368,741 | A | 1/1983 | Meinunger | |
| 4,411,278 | A | 10/1983 | Kastner | |
| 4,572,216 | A | 2/1986 | Josuttis et al. | |
| 4,620,551 | A | 11/1986 | Ruppert et al. | |
| 4,658,837 | A | 4/1987 | Ruppert et al. | |
| 4,697,602 | A | 10/1987 | Pelkey | |
| 4,770,191 | A | 9/1988 | Moscovitch | |
| 4,771,793 | A | 9/1988 | Kastner | |
| 4,832,056 | A | 5/1989 | Bryant et al. | |
| 4,887,617 | A | 12/1989 | Ruppert et al. | |
| 4,913,171 | A | 4/1990 | Lasko | |
| 5,009,237 | A | 4/1991 | Schmidt et al. | |
| 5,072,740 | A | 12/1991 | Gatschmann et al. | |
| 5,088,506 | A | 2/1992 | Kastner | |

(Continued)

FOREIGN PATENT DOCUMENTS

| | | |
|---|---|---|
| DE | 2055673 | 5/1972 |
| DE | 2159054 | 6/1972 |
| DE | 3706504 | 9/1988 |
| FR | 2150199 | 3/1973 |
| GB | 1289563 | 9/1972 |

OTHER PUBLICATIONS

Description of "Excel Platinum Edition" Cigarette Machine, Roll Your Own Magazine (Oct. 2001) (http://www.ryomagazine.com/october2001/injectors.htm).

(Continued)

*Primary Examiner*—Dionne A. Walls
(74) *Attorney, Agent, or Firm*—Wong, Cabello, Lutsch, Rutherford & Brucculeri

(57) ABSTRACT

Devices for filling a cigarette tube with tobacco are disclosed. In one aspect, the devices contain separate metering, compression, and injection mechanisms, which may be manual, partially automatic, or fully automatic. The metering mechanisms move a proper amount of tobacco to a compression chamber, where the tobacco is thereafter compressed for eventual injection. In some embodiments, means are provided for assessing whether a sufficient quantity of tobacco has been metered into the compression chamber, and if not, further metering is accomplished prior to injection. In another aspect, the metering and compression mechanisms are combined into a single mechanism to the same effect.

212 Claims, 23 Drawing Sheets

U.S. PATENT DOCUMENTS

| | | | |
|---|---|---|---|
| 5,105,830 | A | 4/1992 | Brackmann et al. |
| 5,141,000 | A | 8/1992 | Ruppert et al. |
| 5,197,495 | A | 3/1993 | Ruppert et al. |
| 5,398,701 | A | 3/1995 | Neumann et al. |
| 5,450,861 | A | 9/1995 | Colani |
| 5,526,825 | A | 6/1996 | Ruppert et al. |
| 5,615,692 | A | 4/1997 | Ruppert et al. |
| 5,657,768 | A | 8/1997 | Neumann et al. |
| 5,666,975 | A | 9/1997 | Lord |
| 5,749,378 | A | 5/1998 | Ruppert et al. |
| 6,206,006 | B1 | 3/2001 | Schutze |
| 6,557,560 | B2 | 5/2003 | Kastner |

OTHER PUBLICATIONS

Description of "The Amazing Cigarette Machine," http://www.weirdlinks.com/cigmachine.htm (downloaded Oct. 30, 2002; original publication date unknown).

Cigarette machines advertised at "Randy's Tobacco Shop," http://www.thetobaccoshop.com/RYOMachindex.htm (downloaded Oct. 31, 2002; original publication date unknown).

Cigarettes Cheaper!: The Smoker's Newspaper (Jul./Aug. 2003), Advertisement for Geronimo or Noble Injector Machine.

Copy of box for "Easy Roller" cigarette machine, manufactured by C.P. Rolling ApS, and pictures of same (admitted as prior art).

Pictures of Supermatic II cigarette rolling machine, and documentation concerning same taken from http://www.jackgee.com/parts.htm; http://www.jackgee.com/supermatic_ii.htm; and http://www.ryomagazine.com/july2001/injectors.htm (admitted as prior art).

Pictures of MackRoller cigarette rolling machine, and documentation concerning same taken from http://www.webbspot.com/mackroller/ and http://www.webbspot.com/mackroller/cigarette_rolling_machine_vide4.html (admitted as prior art).

Cigarettes Cheaper!: The Smoker's Newspaper (Aug. 2002)—"The Great Cigarettes Cheaper! Make–Your–Own Machine Contest!" a solicitation by the Applicant to the public seeking inputs for a cigarette–tube–filling machine design, and various responses received with various ideas in the late 2000 timeframe.

Nov. 30, 2001 letter regarding a Taiwanese cigarette tube filing device and pictures of same.

Feb. 4, 2002 letter regarding a Taiwanese Chinese cigarette tube filing device and pictures of same.

"Burghart Develops Automatic Cigarette Maker for RYO Testing," Tobacco Reporter Apr. 2002, p. 26.

Information concerning a cigarette tube filling device made by Harting (Germany), dated Sep. 6, 1999.

Information concerning a cigarette tube filling device (La Cigaretterie) made by Cigapur International Inc. (Canada), dated Nov. 22, 1999.

* cited by examiner

DEVICE FOR FILLING A CIGARETTE TUBE WITH A METERED AMOUNT OF TOBACCO

CROSS REFERENCE TO RELATED APPLICATION

This application claims priority under 35 U.S.C. § 119(e) to U.S. provisional patent application Ser. No. 60/428,199, filed Nov. 21, 2002, which is incorporated herein by reference in its entirety.

FIELD OF THE INVENTION

The present invention relates generally to a device for filling cigarette tubes with tobacco, and more particularly to a fully manual, partially automated, or fully automated device for filling cigarette tubes with metered amounts of tobacco.

BACKGROUND OF THE INVENTION

Cigarette tubes generally comprise a paper cylinder having an open end and a filter end. Various machines exist in the market for allowing a user to fill such tubes with loose tobacco to make their own cigarettes.

An example of a prior art cigarette tube filing machine includes the Supermatic II device distributed by Jack Gee's Sales (see http://www.jackgee.com/supermatic_ii.htm). Composition of the internal portions of this device can be found at the following websites: http://www.jackgee.com/parts.htm and http://www.ryomagazine.com/july2001/injectors.htm. This tabletop device is hand crank operated and includes an open rectangular compression chamber on the top of the device into which a user places tobacco to be compressed and formed into a cigarette. The operator turns the hand crank clockwise to compress and eventually inject the compressed tobacco into a cigarette tube affixed to a nozzle on the exterior housing of the device. More specifically, when the user turns the hand crank from its rest position through approximately 90 degrees, a compression slide is moved linearly towards the compression chamber and eventually compresses the tobacco in the chamber into a cylinder to form a plug of tobacco. Thereafter when the hand crank is turned further, through approximately an additional sixty degrees, a mechanism on the hand crank contacts a linear injection slide. This injection slide moves perpendicular to the now-stationary compression slide and parallel to the affixed cigarette tube to push the compressed tobacco plug through the compression chamber and into the waiting cigarette tube.

A similar but automated device is the MackRoller device, distributed by the CigFactory (see http://www.webbspot.com/mackroller/). This device is electrically automated, and allows the user to merely place the cigarette tube on the device, turn on a switch, and compression and injection are performed automatically. However, the MackRoller device appears similar in its structure and internal mechanisms to Supermatic II, with the exception that the hand crank has been replaced by a motor to provide the necessary rotational movement. Videos showing the operation of the MackRoller device can be found at http://www.webbspot.com/mackroller/cigarette_rolling_machine_vide4.html. All websites and associated videos disclosed in this background section are incorporated by reference herein in their entireties.

Another automated device for filling cigarette tube with tobacco includes the EasyRoller device manufactured by CP Rollings ApS of Denmark. This device is also automated and can fill an affixed cigarette tube by merely pushing a button. The device essentially comprises a motor with a screw mechanism affixed to its rotor. The screw mechanism is placed at the bottom of a tobacco hopper for holding loose tobacco and continues through a metal tube onto which the cigarette tube is affixed. When operated, the screw mechanism turns to direct tobacco from the hopper and to compact or "screw" it into the waiting cigarette tube.

These and other cigarette tube filling devices are disclosed in the Information Disclosure Statement that the inventors have filed with this patent application, all of which are incorporated herein by reference. However, none of these devices are believed suitable to service the "roll your own" cigarette market, as they each suffer various drawbacks: some machines are dangerous; others do not adequately fill the cigarette tubes, or do so loosely and irregularly; some do not fill tubes with adequate speed, etc.

Moreover, a problem that seems pervasive in the cigarette tube filling art is that such machines lack the ability to fill tubes with a precise quantity of tobacco on a consistent basis. The Supermatic II and MackRoller device discussed earlier provide a good illustration of this problem. Although such devices can generally adequately compress and inject tobacco into waiting tubes, they depend on the user of the machine to adequately fill the compression chamber with a sufficient amount of tobacco by essentially stuffing some amount of tobacco into the chamber by hand. The machine thus has no means to automate, or meter, a proper amount of tobacco for eventual injection inside of the tubes. Moreover, such devices generally lack means to deal with different cuts of cigarette tobacco, such as shag cut or bulk cut, or tobaccos of various moisture contents, etc. The result is generally the formation of cigarettes which are uneven or incomplete in their density, and/or which may not burn properly or fall apart when burned, which cigarette smokers generally find undesirable.

The present disclosure provides several different embodiments of cigarette tube filling machines which overcome or mitigate such problems of the prior art. In particular, the disclosed machines, amongst other benefits, contain mechanisms for metering a proper amount of tobacco to be compressed and eventually injected. Whether fully manual, partially automatic, or fully automatic versions of the disclosed machine are used, the result is the formation of cigarettes which contain consistent and even amounts of tobacco.

SUMMARY OF THE INVENTION

Devices for filling a cigarette tube with tobacco are disclosed. In one aspect, the devices contain separate metering, compression, and injection mechanisms, which may be manual, partially automatic, or fully automatic. The metering mechanisms move a proper amount of tobacco to a compression chamber, where the tobacco is thereafter compressed for eventual injection. In some embodiments, means are provided for assessing whether a sufficient quantity of tobacco has been metered into the compression chamber, and if not, further metering is accomplished prior to injection. In another aspect, the metering and compression mechanisms are combined into a single mechanism to the same effect.

BRIEF DESCRIPTION OF THE DRAWINGS

The foregoing embodiments of the invention will be best understood with reference to the following detailed description when read in conjunction with the accompanying drawings, in which.

DETAILED DESCRIPTION OF THE INVENTION

I. First Embodiment

Referring to FIGS. 1A–1D, a first embodiment of a partially-automated device 10 for filling cigarette tubes 70 with a measured or metered amount of tobacco 76 is illustrated. In this first embodiment, the metering of the tobacco is automated, while compression and injection are manual, as will be explained in further detail later.

Figure 1A:
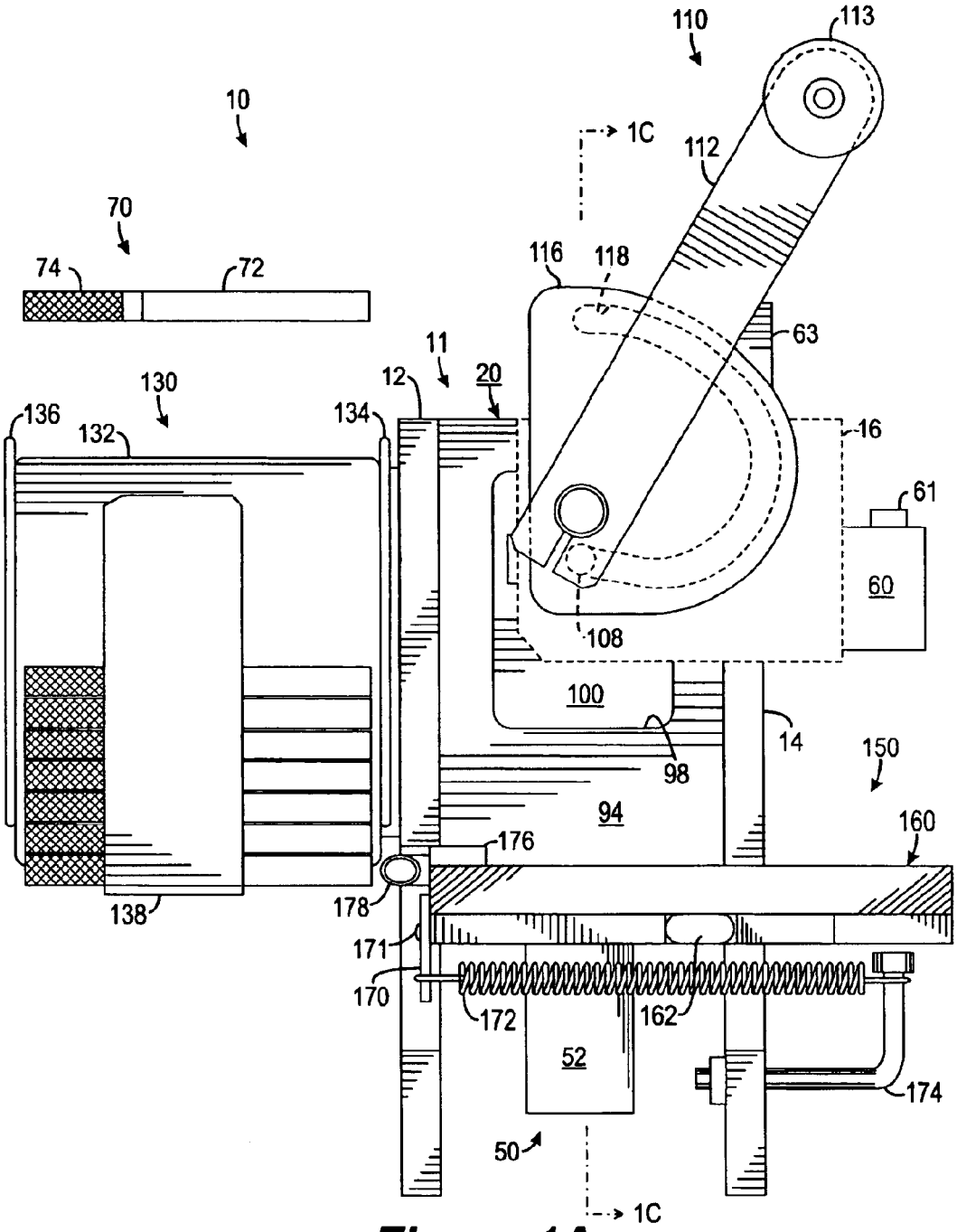
FIGS. 1A–1D illustrate various views of a first embodiment of a device for filling cigarette tubes with metered amounts of tobacco, wherein the disclosed device has an automated metering unit.
Figure 1B:
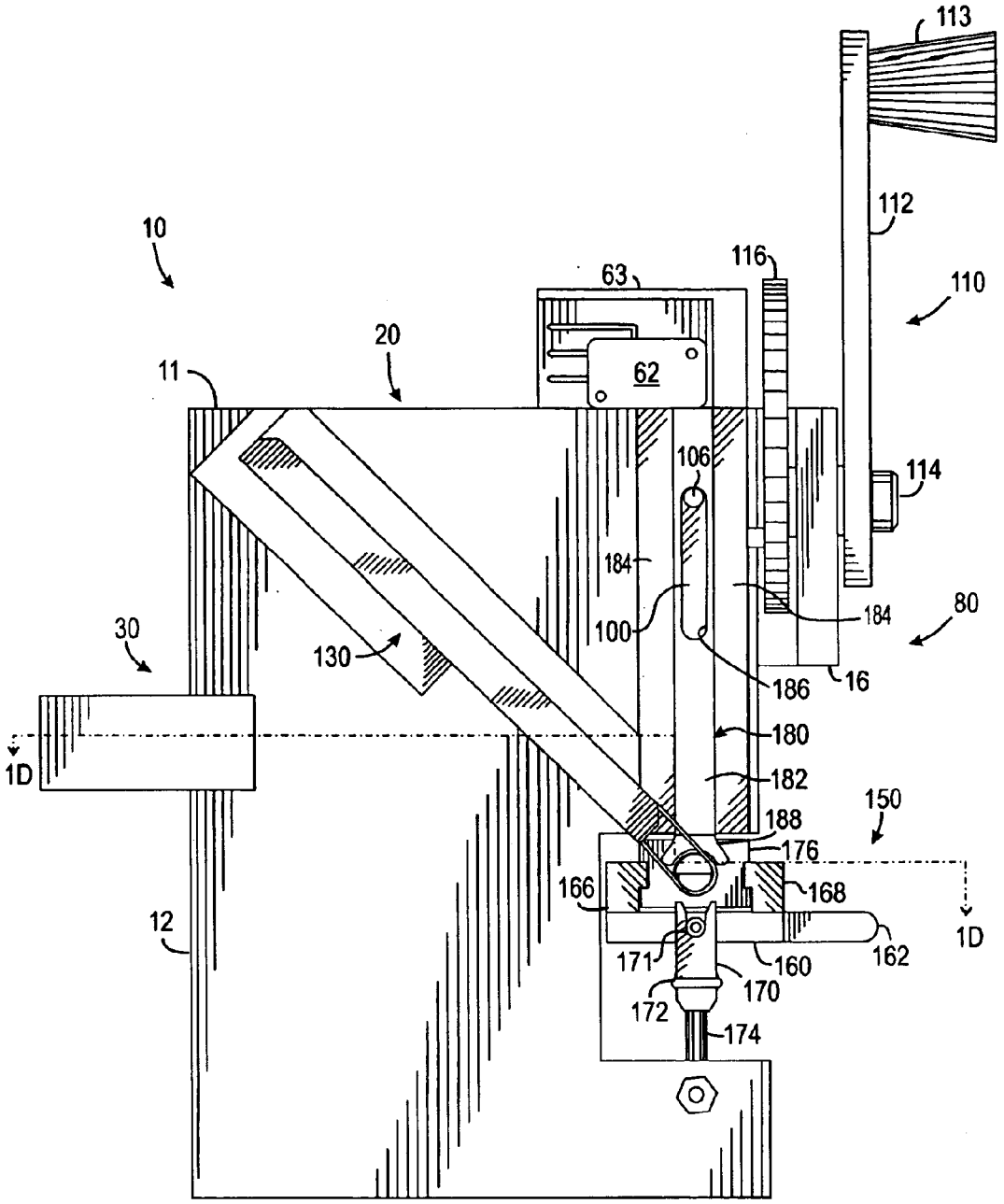
Figure 1C:
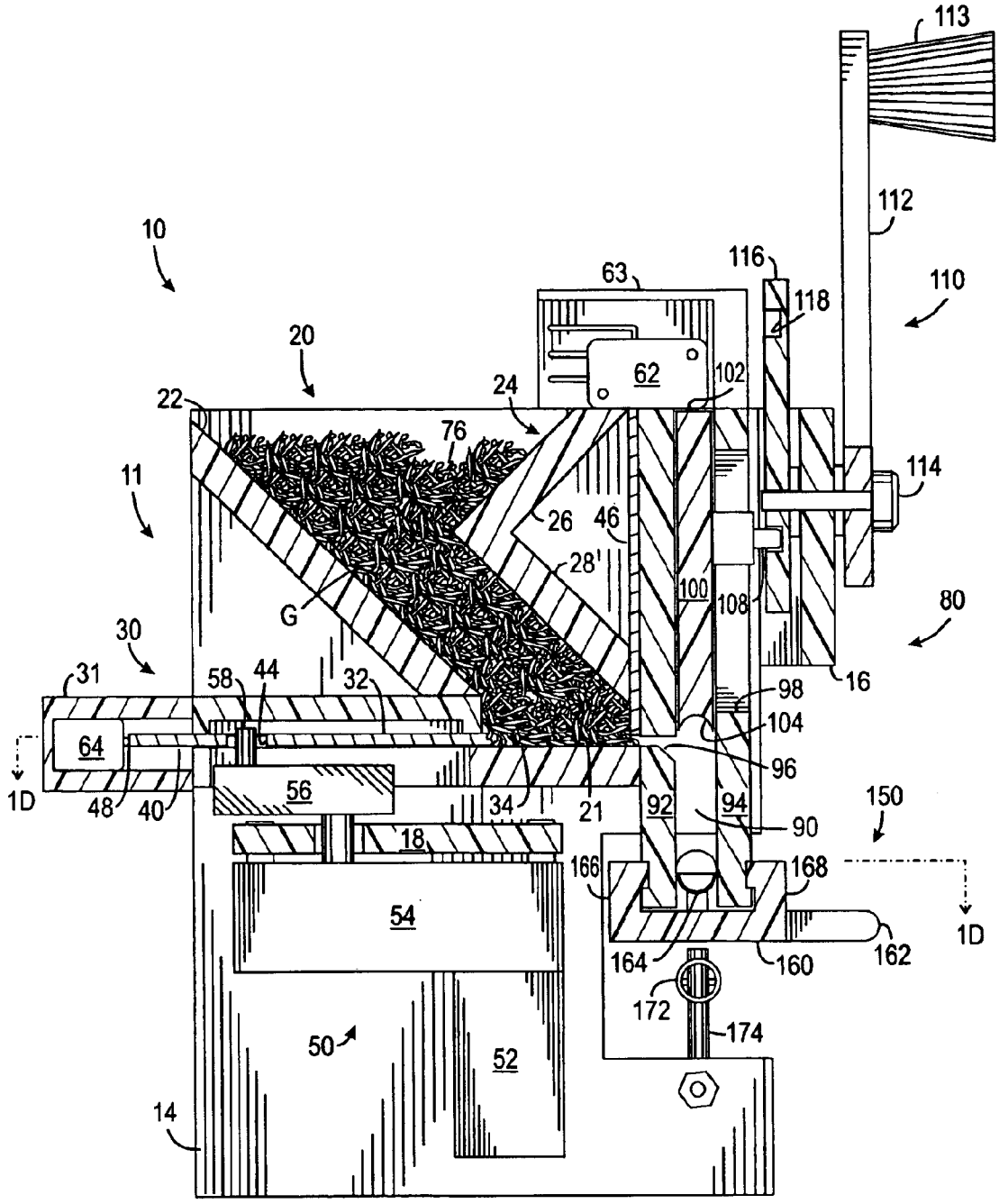
Figure 1D:
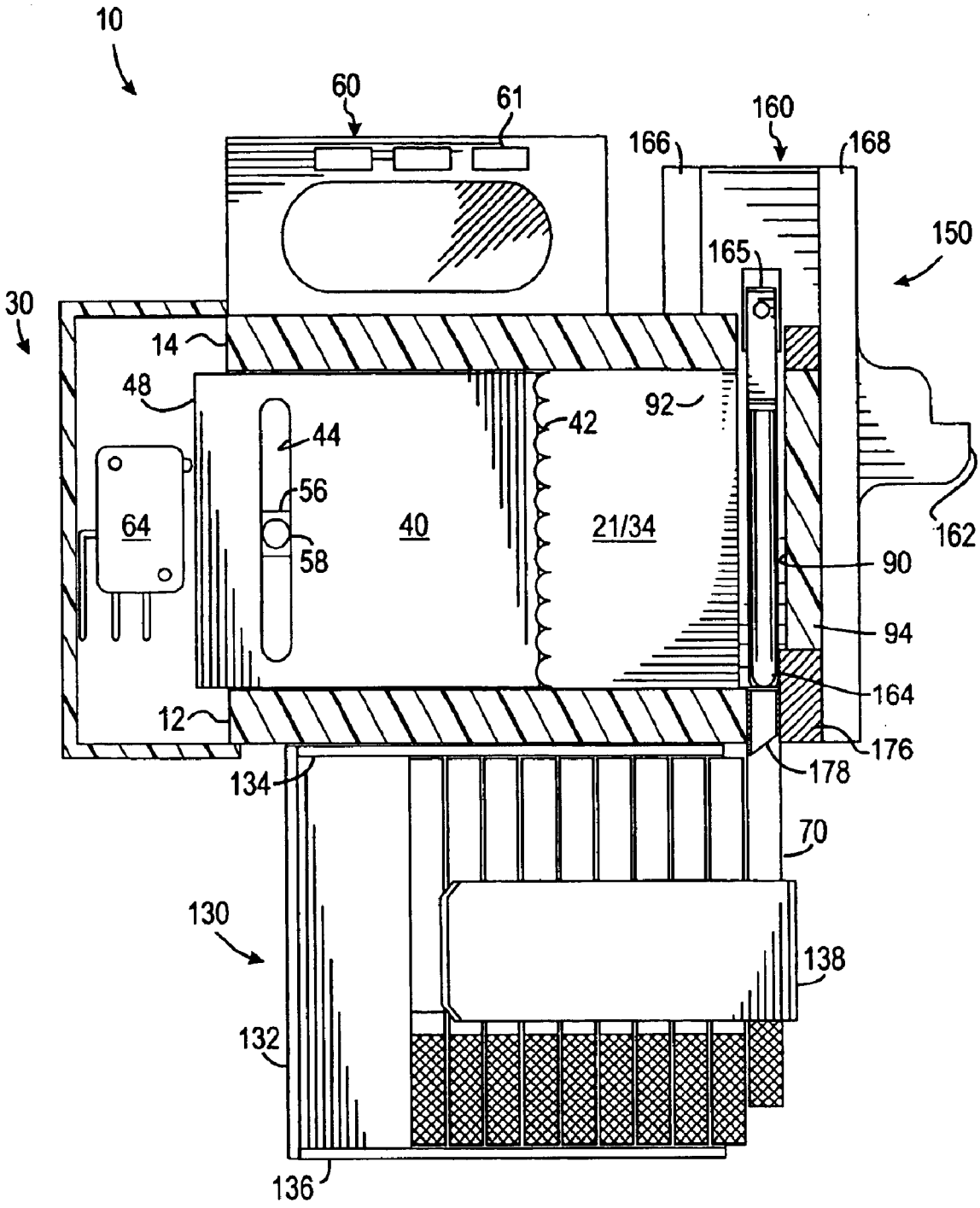

The disclosed device 10 is illustrated in a front elevational view in FIG. 1A and in a side elevational view in FIG. 1B. In FIG. 1C, the disclosed device is illustrated in a side cross-sectional view. In FIG. 1D, the disclosed device 10 is illustrated in a plan view in broken cross-section. The disclosed device 10 is depicted in a basic form to show the gross anatomy of the device. However, it may be aesthetically designed or altered by one of ordinary skill in the art.

The disclosed device 10 includes a body 11, a hopper unit 20, a metering unit 30, a compressing unit 80, a cigarette tube magazine 130, an injecting unit 150, and a clamping unit 180. The disclosed device 10 is preferably sized to sit on a table for easy use by a "roll your own" smoker. However, the disclosed device 10 could be made larger or smaller to fit a desired implementation, or could be used in a manufacturing or production environment. The various components of the disclosed device 10 can be composed of suitable metals and/or plastics. Preferably, high stress or wear prone components are composed of metal. Furthermore, slideable components preferably use metal to plastic or plastic-to-plastic interfaces which do not require the addition of oil or grease.

The hopper unit 20 as best shown in FIG. 1C is formed in the body 11 and is used to store and deliver tobacco 76 to the metering unit 30. In turn, the metering unit 30 is used to meter or measure tobacco 76 from the hopper 20 to the compressing unit 80 and injecting unit 150. The compressing unit 80 is used to compress the tobacco 76, and the injecting unit 150 is used to insert a resulting compressed plug of tobacco 76 into a cigarette tube 70 positioned on the magazine 130 (FIG. 1D). The clamping unit 180, as best shown in FIG. 1B, is used to firmly hold an open end of the cigarette paper portion 72 (FIG. 1A) of the cigarette tube 70 adjacent the injecting unit 150 during insertion of the compressed plug of tobacco 76. Such tubes 70 also usually contain a filter 74.

The body 11 (FIG. 1B) has first and second sidewalls 12 and 14 (FIG. 1A), which are used to contain and mount the various components of the device 10. The hopper 20 is formed in the body 11 between the sidewalls 12 and 14. As best shown in FIG. 1C, the hopper 20 has a first or lower surface 21, a first funnel wall 22, and a baffle unit 24. The baffle unit 24 has a second funnel wall 26 and a third holding wall 28. The funnel walls 22, 26, and 28 are preferably angled at approximately 45-degrees with respect to the lower surface 21 of the hopper 20 as shown. In a preferred embodiment, the first funnel wall 22 and the holding wall 28 define a horizontal gap G of approximately 1-inch, and the lower surface 21 of the hopper 20 defines a surface area of approximately 4 square inches.

Loose tobacco 76 is placed in the hopper 20, and the walls 22, 26, and 28 direct the loose tobacco 76 towards the lower surface 21 of the hopper 20 where the metering device 30 is located. Because loose tobacco 76 is composed of flat shreds or cuts of tobacco, it may tend to bunch up or clog, which may prevent the metering plate 40 from adequately passing the loose tobacco to the compression chamber 90, as is described in more detail below. The baffle unit 24 is particularly suitable for preventing such an occurrence. The funnel walls 22 and 26 limit the volume of loose tobacco capable of positioning at the bottom of the hopper 20. In addition, the holding wall 28 holds the loose tobacco 76 adjacent the lower surface 21 of the hopper 20 when the metering unit 30 is operating. The baffle unit 24 is preferably capable of holding an approximately 1-inch layer of tobacco adjacent the lower surface 21 of the hopper 20.

Although not shown in the figures, other schemes may be employed to bias the loose tobacco 76 downward in the hopper 20. For example, a floating weight may be placed on top of the tobacco in the hopper 20, or a spring biased panel or level may be used to push the tobacco downward. Such a spring biased device could also be incorporated into a cover for the top of the hopper or could be attached inside of the hopper 20. In any event, there are many different ways to bias the tobacco downward as one skilled in the art will recognize, and in this regard the baffle structure is not strictly necessary. Instead, the hopper 20 may be built essentially as a box with vertical or substantially vertical sidewalls, and not even require a downward biasing scheme if the weight of the tobacco in the hopper is sufficient for proper operation.

As best shown in FIG. 1C, the metering unit 30 includes an outer housing 31, upper and lower guide surfaces 32 and 34, a metering plate 40, and a shear plate 46. The metering unit 30 also includes an automated metering actuator 50 having a motor 52, a gearbox 54, and a slide crank 56, which are not shown in cross-section in FIG. 1C for clarity. The metering unit 30 also includes a control unit 60, which is shown in FIG. 1D and is attached to the second sidewall 14.

As best shown in FIG. 1C, the metering plate 40 is positioned between the first and second guide surfaces 32 and 34. The first guide surface 32 terminates at the lower funnel wall 22. The second guide surface 34 extends towards the compressing unit 80. One end 42 (see FIG. 1D) of the metering plate 40 is adjacent the tobacco 76 in the hopper 20 and is movable relative to the shear plate 46. The shear plate 46 is oriented substantially perpendicular to the metering plate 40 and is positioned adjacent the compressing unit 80 as described below.

As best shown in the top view of FIG. 1D, the one end 42 of the plate is preferably serrated and beveled. The serrated end 42 is used for agitating and cutting the loose tobacco. For example, the serrated end 42 is capable of catching the loose shreds of tobacco 76 at the bottom of the hopper 20 and cutting the shreds against the shear plate 46 (see FIG. 1C). The metering plate 40 contains a lateral slot 44 for an eccentrically located pin 58 on the slide crank 56. Another end 48 of the metering plate 40 abuts against a counting switch 64 when the metering plate is set in motion by the control unit 60. The metering plate 40 preferably has a thickness of approximately 0.06-inch and a width of approximately 2.7-inch along its serrated end 42.

As best shown in FIG. 1C, the motor 52 and gearbox 54 are attached to a metering mount 18 connected between the sidewalls of the device. The motor 52 and gearbox 54 connect to the slide crank 56. The eccentrically located pin 58 on the slide crank 56 is disposed in the lateral slot 44 defined in the metering plate 40. Rotation of the motor 52 is transferred through the gearbox 54 to the slide crank 56 such that when the slide crank 56 is rotated, the eccentrically located pin 58 in slot 44 repetitively moves the metering plate 40 back and forth between the guide surfaces 32 and 34. As noted above, the slot 44 where the eccentric pin 58 of the slide crank 56 is inserted is defined laterally in the plate 40. Thus, as the eccentric pin 58 is rotated with the slide crank 56, the pin 58 will move the plate 40 back and forth longitudinally (i.e., left to right in FIGS. 1C and 1D) but not laterally.

The motor 52 can be a conventional DC motor used in household appliances or office equipment. In one example, a 12-V DC motor having model no. RS-385SH and manufactured by Mabuchi Motors can be used. This DC motor can provide torque of approximately 72.9 g-cm at maximum efficiency. Use of the gearbox 54 is preferred with the motor 52, although this may not be strictly necessary depending on the motor or actuator used. Preferably, the motor 52 and gearbox 54 are capable of providing about 10 in-lbs. of torque. One of ordinary skill in the art, however, will appreciate that a number of motors and/or gearboxes can be used with the disclosed device 10, and that selection of the same will be dictated by the functions that the motors and/or gear boxes must perform.

The control unit 60 controls operation of the metering unit 30. The control unit 60 includes a counter (not shown), input controls 61, a first limit or activation switch 62, and a second limit or counting switch 64. For clarity, other necessary electronics known in the art are not shown in the FIGS. 1A–D.

The first activation switch 62, best shown in FIG. 1C, is located atop the device 10 and can have an external housing 63. Activation of the switch 62 is controlled by the compressing unit 80. The counting switch 64 is located adjacent the end 48 of the metering plate 40. The control unit 60 connects to a power supply (not shown) and is capable of providing power to the motor 52 when the activation switch 62 is activated by the compressing unit 80.

As the motor 52, gearbox 54, and slide crank 56 cause the metering plate 40 to move back and forth, the end 48 of the plate 40 makes repeated contact with the counting switch 64. The counter (not shown) within the control unit 60 is used to track each repeated contact to determine when a suitable number of strokes of the metering plate 40 have occurred in accordance with the user's input at input controls 61. In this regard, the input controls 61 on the control unit 60 allow the user to set an amount of tobacco to be metered from the hopper 20 to the compressing unit 80, which in turn ultimately affects the amount of tobacco 76 in the cigarette and/or its density. Using input controls 61, the user can input a number of strokes of the metering plate 40, or can select from one or more predetermined choices (e.g., by pressing input control buttons 61 labeled as "light," "medium," or "heavy,") each associated with a number of stokes. Alternatively, the device may be preset to perform only a set number of metering plate 40 strokes and not allow the user to specify the same.

As best shown in the cross-section of FIG. 1C, the compressing unit 80 includes a compression chamber 90, a compression member 100, and a cranking unit 110. The compression chamber 90 is defined by first and second walls 92 and 94 connected between the sidewalls of the device. The first wall 92 defines a slit or opening 96 for the passage of tobacco 76 from the hopper 20 to the compression chamber 90 when the tobacco 76 is moved therethrough and passed the shear plate 46 by the serrated end 42 of the metering plate 40. (Of course, the edge of the first wall 92 proximate the opening 96 may also act as a shear plate 46, which otherwise may not be needed). Preferably, the slit 96 is chamfered adjacent the compression chamber 90. The second wall 94 of the chamber 90 defines an opening 98 for components of the compression member 100 to connect with components of the cranking unit 110.

The compression member 100 is vertically movably between the walls 92 and 94 of the compression chamber 90. The compression member 100 has a first end 102 capable of activating the activation switch 62 when the compression member 100 is moved to its top-most position within the chamber 90. The compression member 100 also has a second end 104 that defines a cylindrical surface, and which is used to compress and form tobacco in the compression chamber 90 into the proper cylindrical shape ("plug") prior to insertion into the cigarette tube when the member 100 is moved to its bottom-most position within the chamber 90.

As best shown in FIG. 1B, the compression member 100 includes a clamp pin 106 extending from a side of the member 100. The clamp pin 106 fits into a slot 186 contained within a clamp rod 182 of the clamping unit 180. The clamp rod 182 is movable between tracks 184 outside the first sidewall 12. The end of the clamp rod 182 has a gripping member 188, which is preferably composed of an elastomer which is used to hold a cigarette tube to the device as will be described in more detail later. Through engagement of the clamp pin 106 in the slot 186 of the clamp rod 182, the gripping member 188 is movable relative to a tube holder or nozzle 178 (FIG. 1A) on an end block 176 of the injecting unit 150 to be described below.

While the gripping member 188 is shown as coupled to or in communication with the compression member 100, this is not strictly necessary. Instead, the gripping member 188 may constitute a separate device mounted on the exterior of the housing that allows a user to clamp the cigarette tube 70 to the device prior to operating the device. (See FIG. 10B, element 790).

As best shown in FIG. 1C, a cam pin 108 projects from the face of the compression member 100 through the aperture 98 defined in the wall 94 of the compression chamber 90. The cam pin 108 engages the cranking unit 110 for moving the compression member 100 within the chamber 90.

The cranking unit 110 includes a crank arm 112, a shaft 114, and a cam member 116. The crank arm 112 is attached to the shaft 114, which is rotatable on a bearing mount 16 of the body 11. The cam member 116 is also attached to the shaft 114 and is rotatable with the arm 112 and shaft 114. Additional bearings and washers (not shown) may be used between the cam member 116, mount 16, and shaft 114.

The cam member 116 defines an eccentric or spiral slot 118 (see FIGS. 1A and 1C) in which the cam pin 108 of the compression member 100 is inserted. A user uses a handle 113 on the crank arm 112 to rotate the cam member 116. With rotation of the cam member 116, the cam pin 108 moves within the eccentric slot 118, and the compression member 100 is moved up or down between the walls 92 and 94 of the chamber 90 depending on the direction of rotation of the crank arm 112.

In FIG. 1A, the crank arm 112 and cam member 116 are illustrated in an extreme counterclockwise position, and the compression member 100 is moved to its top-most position. When so positioned, the top end 102 of the compression member 100 engages the activation switch 62 (see FIG. 1C), as will be described in further detail later. When the crank arm 112 is rotated clockwise from the position shown in FIG. 1A, for example, the compression member 100 is moved down so that its bottom end 104 can compress against any loose tobacco at the bottom of the compression chamber 90.

As best shown in FIG. 1A, the injecting unit 150 includes a shuttle 160, a stop 170, spring 172, retainer 174, an end block 176, and a tube holder 178. As best shown in FIG. 1C, the shuttle 160 includes a trigger 162, an insertion member 164, and guides 166 and 168. The shuttle 160 is positioned below the compression chamber 90 and is movable along the guides 166 and 168. As best shown in FIG. 1D, the trigger 162 extends from a side of the shuttle 160 and is intended to engage with the arm 112 (FIG. 1C) of the cranking unit 110 as described below. The insertion member 164 is positioned between the guides 166 and 168 and has one end 165 attached to the shuttle 160. The insertion member 164 preferably defines a half-cylindrical surface that tapers towards its distal end. Such a shape is known in the art for facilitating the insertion of a compressed plug of tobacco in a cigarette tube.

The guides 166 and 168 fit into slots defined in the lower end of the walls 92 and 94 (FIG. 1C) and are movable therein for guiding movement of the shuttle 160. As best shown in FIG. 1A, the stop 170 is connected at an end of the shuttle 160 with a fastener 171. The spring 172 is interconnected between the stop 170 and the retainer 174, which is attached to the second side wall 14 of the body 11. When the spring 172 is not extended, the shuttle 160 is in an extreme lateral position (i.e., the right-most position in FIG. 1A), and the stop 170 engages the end block 176, which prevents the shuttle 160 from moving further towards the retainer 174.

When rotated in the clockwise direction, the crank arm 112 eventually engages the trigger 162 of the shuttle 160, stretches the spring 172, and moves the shuttle 160 towards the tube magazine 130. When so moved, and as best shown in FIG. 1D, the distal end of the insertion member 164 can then be disposed through the nozzle 178 attached to an opening of the end block 176.

As best shown in FIG. 1A, the tube magazine 130 is attached to the first side wall 12 and has a bottom surface 132 and two sides 134 and 136. The bottom surface 132 angles towards the injecting unit 150. A fold over 138 is formed on the open end of the bottom surface 132 adjacent the injecting unit 150 to hold cigarette tubes 70 against the bottom surface 132 and adjacent the injecting unit 150. The magazine 130 can hold a plurality of cigarette tubes 70.

With the benefit of the above description, operation of the disclosed device 10 will now be discussed with reference to FIGS. 2A–4.

Figure 2A:
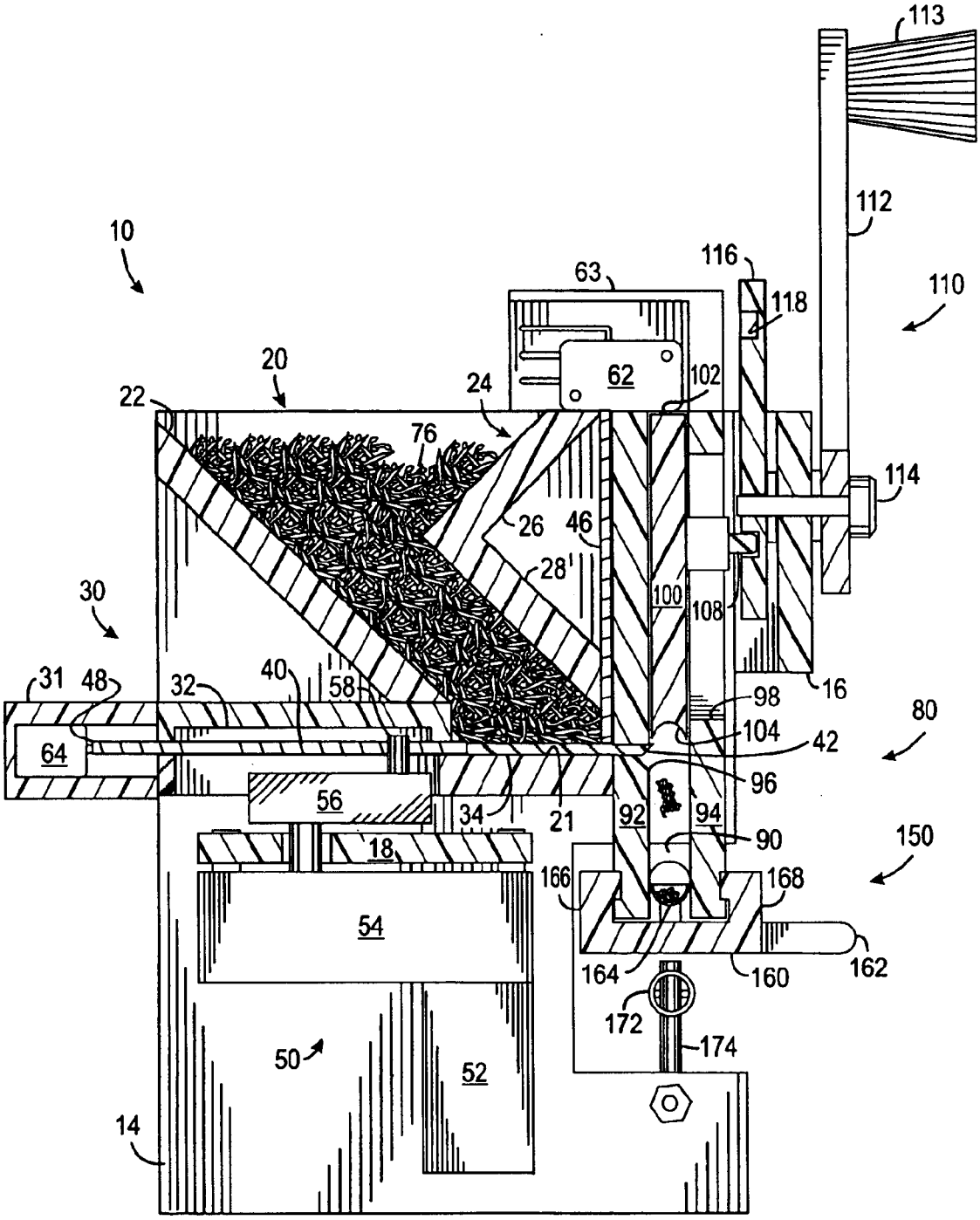
FIGS. 2A–2B illustrate various views of the first embodiment in a stage of operation in which an amount of tobacco is being metered.
Figure 2B:
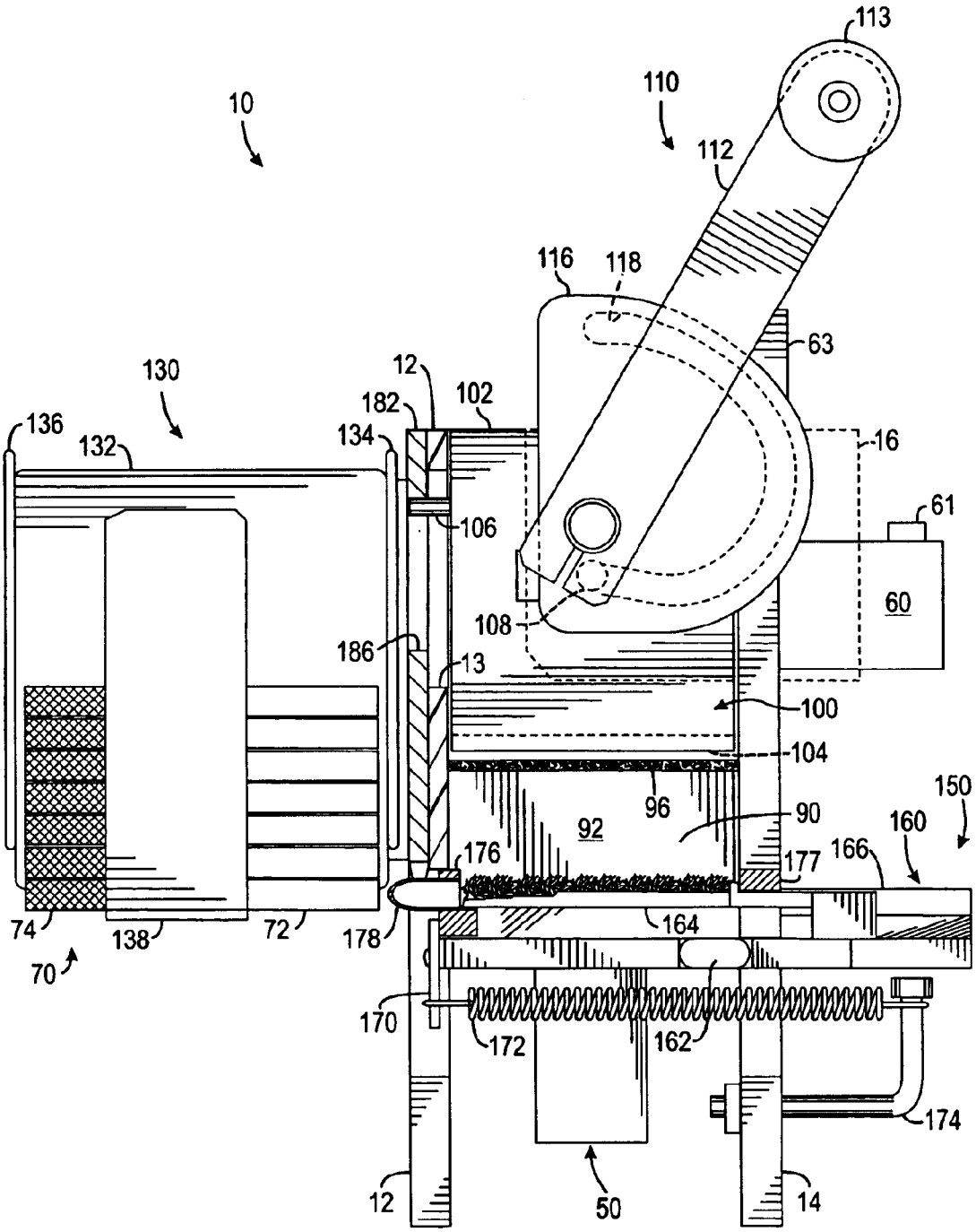

Referring to FIGS. 2A–B, the device 10 is shown in various stages during the metering process in which an amount of tobacco 76 is being metered from the hopper 20 to the compression chamber 90. In FIG. 2A, the disclosed device 10 is shown in a side cross-section. In FIG. 2B, the disclosed device 10 is shown in a frontal view with certain components missing or in dotted lines to reveal internal components of the disclosed device 10. For example, the wall 94 and the guides 168 are removed so that the first wall 92, slit 96, and insertion member 164 are visible in FIG. 2B. Also, the first sidewall 12, clamp member 182, end block 176, and nozzle 178 are shown in cross-section.

During operation, a user fills the hopper 20 with a sufficient amount of loose tobacco 76, and positions several cigarette tubes 70 in the magazine 130 with their open paper end adjacent the sidewall 12. The user manually inserts an open end of the first tube 70 over the tube holder or nozzle 178 adjacent the compression chamber 90. Preferably, the tube holder 178 defines an angled opening as shown to facilitate insertion into the cylindrical paper portion 72 of the tube 70.

Using the input 61 of control unit 60, the user then selects a desired amount of tobacco for filling the tube 70 as discussed earlier. Then, the user turns the crank arm 112 to an extreme counterclockwise position as shown in FIG. 2B, which brings the top end 102 of the compression member 100 into contact with the activation switch 62, which in turn informs the control unit 60 that the metering unit 30 can be activated.

The user then activates an appropriate input 61 on the control unit 60 to start metering and to provide power to the motor 52. Rotation from the motor 52 is transferred through the gearbox 54 to the slide crank 56, etc., as described earlier, which ultimately causes the metering plate 40 to slide between the guide surfaces 32 and 34. As the serrated end 42 is repetitively moved passed the shear plate 46, an amount of loose tobacco 76 is moved from the hopper 20, through the slit 96 in wall 92, and ultimately to the compression chamber 90, as shown in FIG. 2A.

As noted above, not only does the holding wall 28 limit the amount of tobacco 76 at the bottom of the hopper 20, but it maintains the loose shreds of tobacco 76 adjacent the bottom surface 21 of the hopper 20 as the serrated end 42 of the plate 40 is pushed towards the compression chamber 90. Without this feature, the tobacco 76 might otherwise merely be pushed around in the hopper 20 without passing through the slit 96. Again, other means for biasing the tobacco 76 downward on the hopper 20, such as those discussed earlier, can be used.

The shear plate 46 serves the dual function of cutting excessively long shreds of the tobacco 76 and limiting the amount of tobacco capable of passing from the hopper 20 to the compression chamber 90. In any event, the metering plate 40 and the shear plate 46 can accommodate various styles or cuts of loose tobacco, such as shag or bulk cuts. Cutting of the tobacco (if needed depending on the tobacco used) is beneficial so that tobacco 76 compressed and inserted in the cigarette tube 70 has a predictable consistency. The tobacco 76 when ultimately inserted in the cigarette tube 70 preferably has a fine consistency which helps to maintain the integrity of the cigarette and make the tobacco 76 less likely to fall out of the tube 70 during handling or smoking. The shear plate 46 may be permanently attached to the wall 92 or may wholly constitute the wall 92. Alternatively, the shear plate 46 may be attached to the wall 92 in a manner where its vertical position can be modified by the user, which allows for adjustment of the amount of tobacco to be passed to the compression chamber 90 or the degree to which it is cut. Of course, the slit 96 would need to be larger that shown when used with an adjustable shear plate.

As the serrated end 42 of the metering plate 40 is drawn away from the shear plate 46 by the motor 52, more tobacco 76 is allowed to move to the bottom surface 21 of the hopper 20. With each backward draw, the second end 48 of the metering plate 40 activates the counting switch 64. The counter (not shown) in the control unit 60 counts each backward draw and cuts power to the motor 52 when the preset number of repeated draws has been reached by the metering plate 40. Consequently, a metered amount of tobacco is delivered to the compression chamber 90 and collects on the cylindrical surface of the injection member 164, as shown in FIG. 2B. The metered amount of tobacco moved from the hopper 20 to the compression chamber 90 depends on a number of variables, such as the dimensions of the metering plate 40, the hopper 20, the opening defined by the shear plate 46, the number of draws made with the metering plate 40, the cut of the tobacco used etc. Typically, a cigarette tube 70 can hold about 0.8-grams of tobacco. The metering plate 40 may make approximately 6 to 20 repetitive draws of loose tobacco 76 to meter such a sufficient amount of tobacco, and the entire metering process may only take about 15-seconds.

Figure 3A:
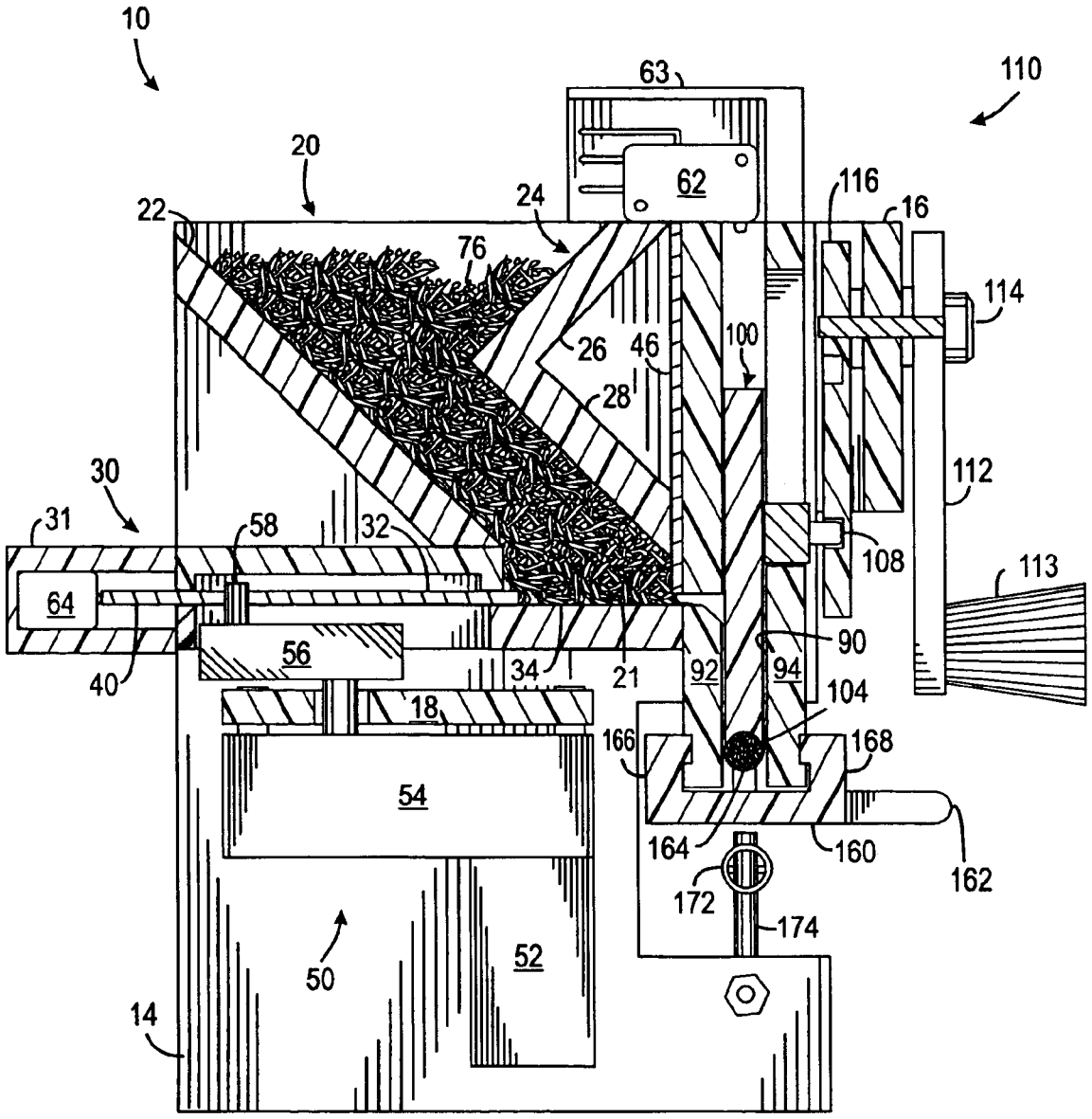
FIGS. 3A–3B illustrates various views of the first embodiment in a further stage of operation in which the metered amount of tobacco is being compressed.
Figure 3B:
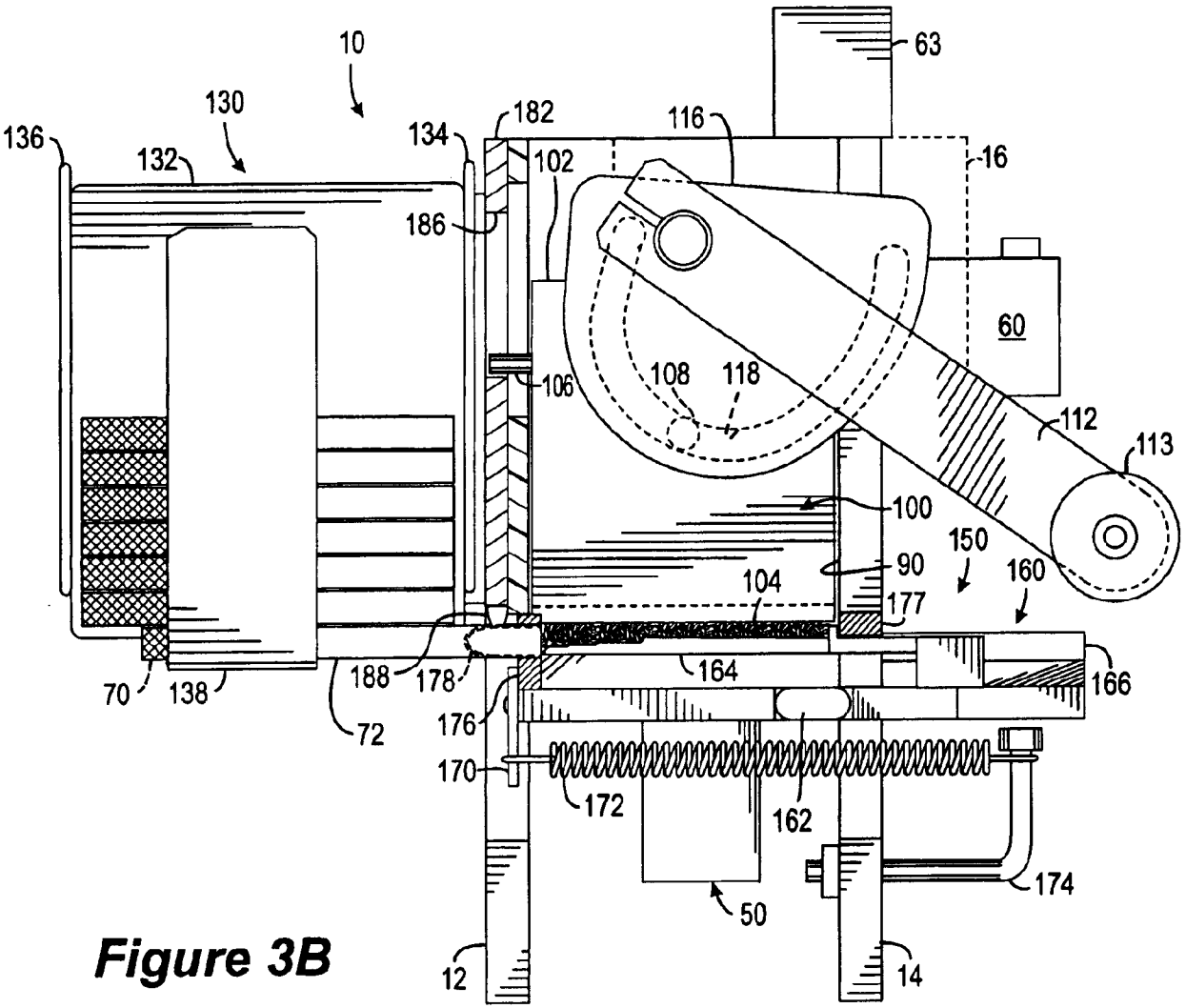

Referring to FIGS. 3A–3B, the disclosed device 10 is shown in various stages during the compression operation, i.e., in which the tobacco metered into the compression chamber 90 is compressed. As noted above, after the metering unit 30 has metered the desired amount of tobacco 76 onto the injection member 164, the control unit 60 shuts off the metering unit 30, at which point the user then rotates the cam arm 112 in a clockwise position. Such rotation of the cam arm 112 and affixed cam member 116 moves the compression member 100 downward within the compression chamber 90 through the interaction of the cam pin 108 and the eccentric groove 118 of the cam member 116. The cylindrical end 104 of the compression member 100 presses against the loose tobacco 76 collected on the insertion member 164, forming a substantially cylindrical plug of tobacco.

As the cam arm 112 is rotated and the compression member 100 is moved downward, the clamp pin 106 (FIG. 3B) eventually engages an end of the slot 186 defined in the clamp rod 182, which also moves the clamp rod 182 downward towards cigarette tube holding nozzle 178. The gripping member 188 on the end of the rod 182 is thus held against the paper portion 72 of the tube 70 installed on the nozzle 178. With the tube 70 firmly held in place in this manner, the process can continue to the injection operation, which is describe with reference to FIG. 4.

Figure 4:
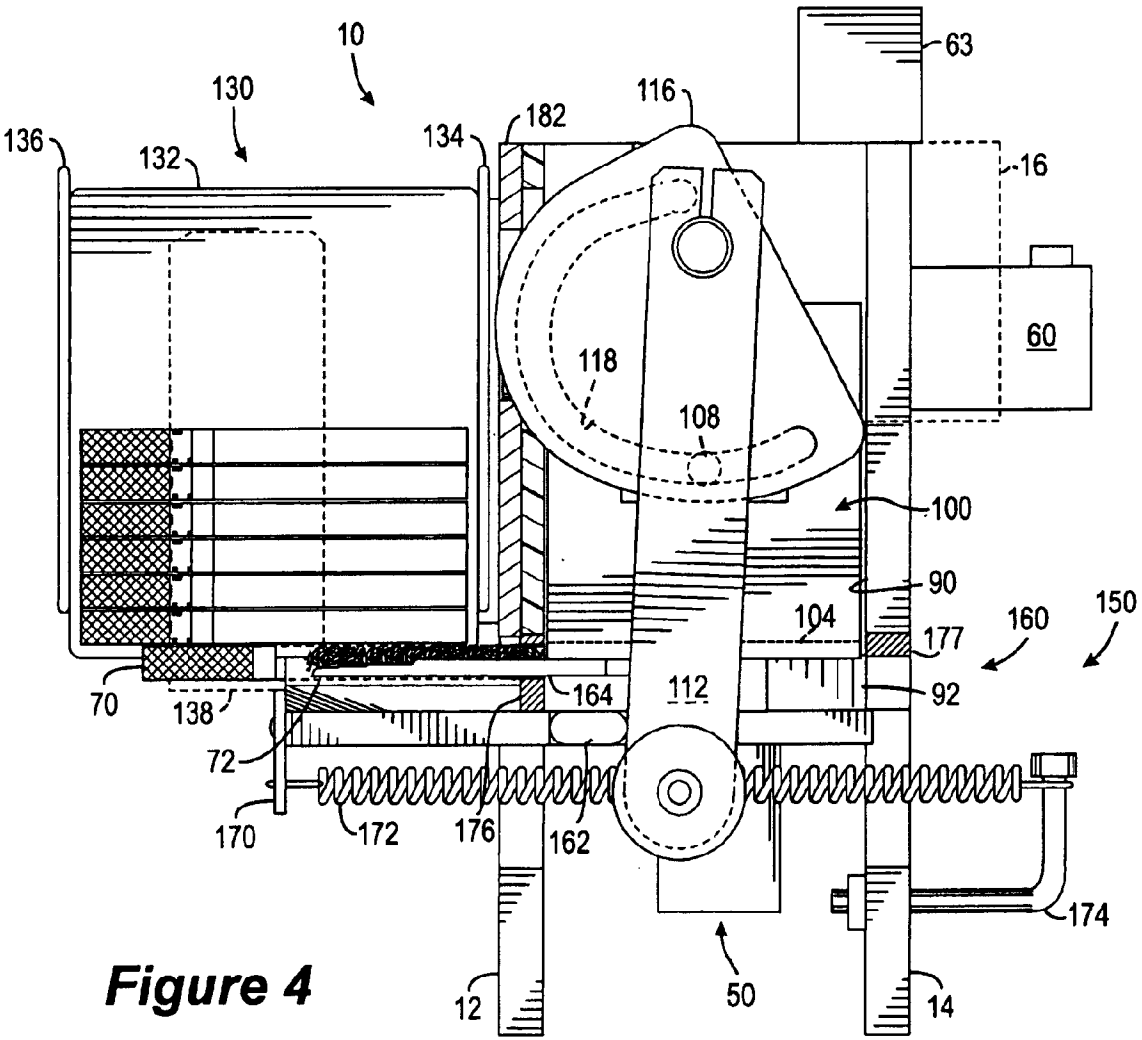
FIG. 4 illustrates a partially exposed front view of the first embodiment in a yet further stage of operation in which the metered and compressed tobacco is injected into a cigarette tube.

Referring to FIG. 4, as the user continues to rotate the arm 112 clockwise, the arm 112 eventually contacts the trigger 162 on the shuttle 160 to move it laterally (i.e., to the left in FIG. 4). Still further rotation overcomes the bias of the spring 172, and moves the insertion member 164 and compressed plug of tobacco 76, which is still compressed thereon by the bottom end 104 of the compression member 100. The distal end of the insertion member 164 passes through the nozzle 178 and into the cylindrical paper portion 72 of the cigarette tube 70. As noted earlier, the gripping member 188 holds the paper portion 72 in place during injection.

When the arm 112 and shuttle 160 reach an extreme lateral position (not show in FIG. 4), the user reverses rotation of the arm 112 (i.e., counterclockwise). The shuttle 160 and insertion member 164 retract from the tube 70 due to the bias of the spring 172, with the plug of tobacco 76 remaining in the cylindrical tubular portion 72. In addition, eventually the compression member 100 and clamping unit 180 are moved upwards. The filled cigarette tube 70 can then be removed from the nozzle 178 and the next tube 70 can be prepared for filling by slipping it over the nozzle 178. When the user rotates the arm 112 to an extreme counterclockwise position (FIG. 2B), the compression member 100 again engages the activation switch 62 so the entire procedure can be repeated for metering, compression, and injecting the next cigarette tube 70 in the magazine 130. Using the disclosed device 10, a user can fill approximately four cigarette tubes 70 within approximately one minute.

II. Second Embodiment

Figure 5A:
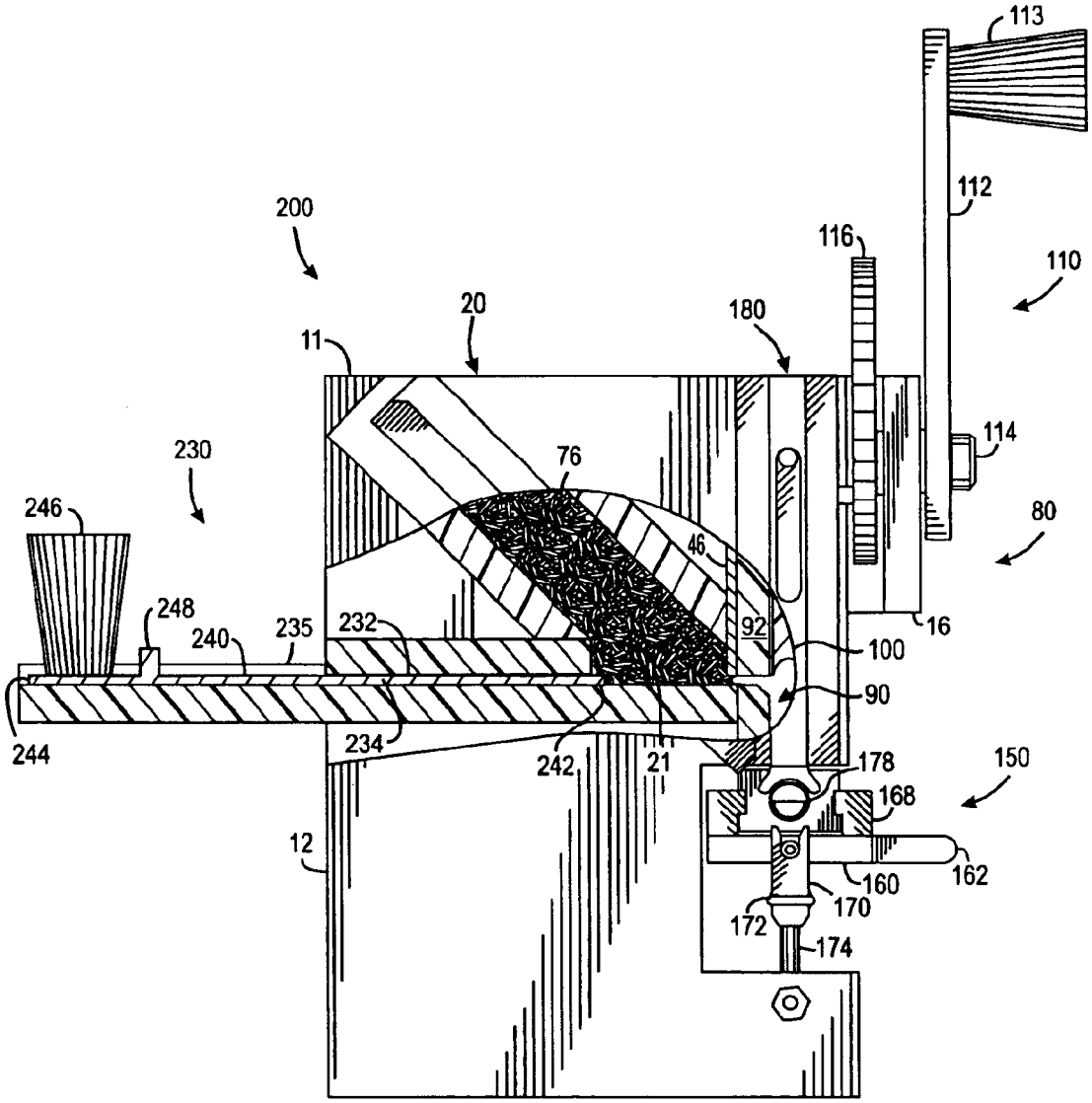
FIGS. 5A–5B illustrate second embodiments of manually operated devices for filling cigarette tubes with metered amounts of tobacco.
Figure 5B:
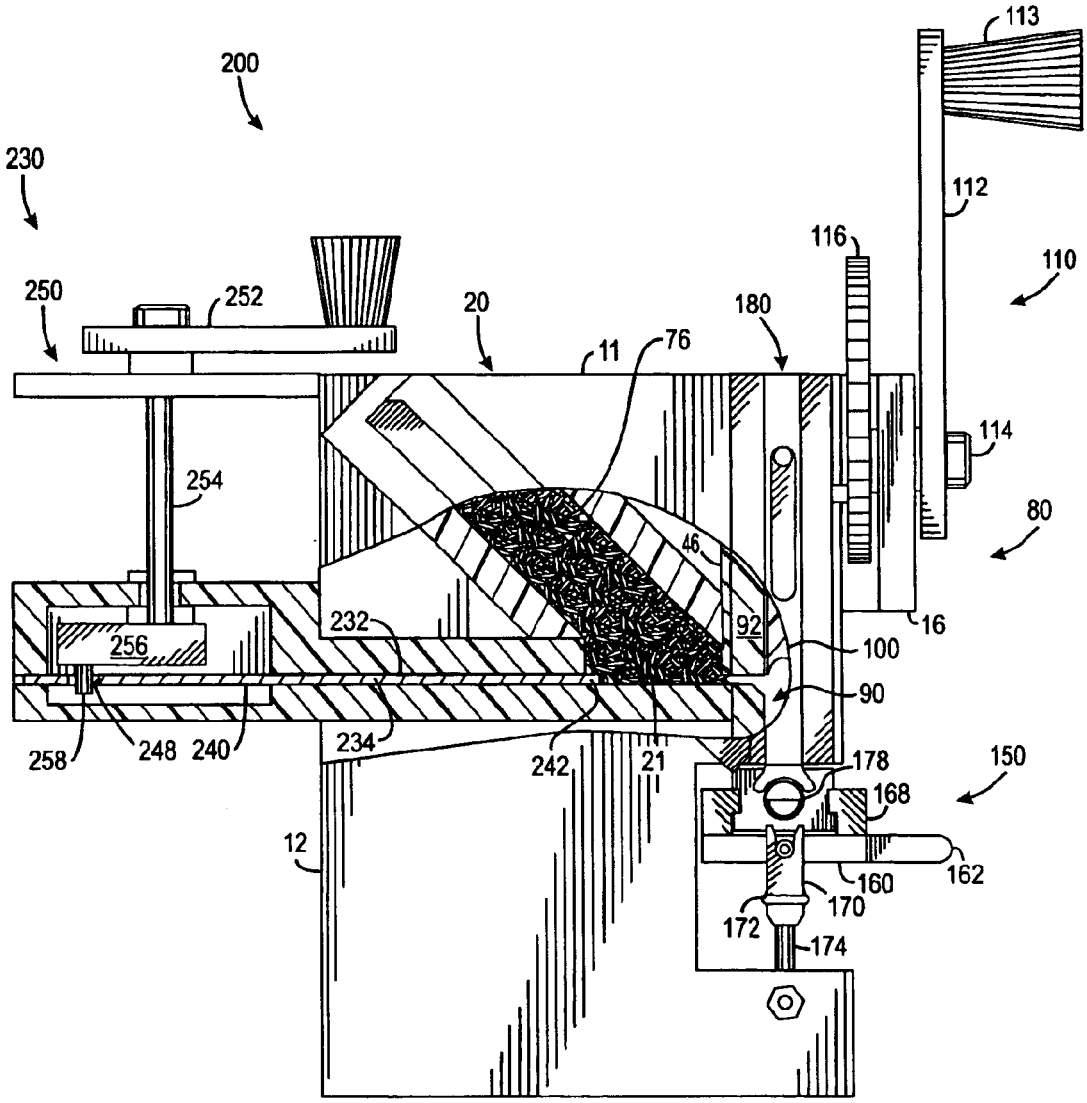

FIGS. 5A–5B illustrate second embodiments of a device 200 for filling cigarette tubes which are fully manual. More specifically, and in contrast to the first embodiment, the metering process in these second embodiments are performed manually by the user. For convenience, the same element numerals are in this second embodiment to represent substantially similar components disclosed with respect to the first embodiment, with discussion of such similar components omitted for brevity.

In FIG. 5A, the disclosed device 200 is partially exposed in a side view to reveal internal details. The disclosed device 200 includes a manually-operable metering unit for metering amounts of tobacco 76. The metering unit 230 includes guide surfaces 232 and 234, a metering plate 240, a handle 246, and a stop 248. As before, the metering plate 240 is movable between the guide surfaces 232 and 234. The metering plate 240 has a serrated and beveled end 242 movable in relation to the shear plate 46 for metering amounts of tobacco 76 from the hopper 20 to the compression chamber 90.

The handle 246 is attached to another end 244 of the plate 240 which extends beyond the body 11 of the device 200. The second or lower guide surface 234 also extends beyond the body 11 for guiding and supporting the plate 240. The lower guide surface 234 can also include side walls, such as the back wall 235 shown, for guiding the plate 240 and to prevent it from moving from side to side as it is moved from left to right. The stop 248 is positioned on the plate 240 to engage the body 11 to prevent over insertion of the plate 240.

To operate the metering unit 230, a user holds the handle 246 and draws the metering plate 240 back and forth to meter amounts of tobacco from the hopper 20 to the compression chamber 90. The other operations of the disclosed device 200 are similar to those described previously.

FIG. 5B shows an alternative to the use of the manual handle 246 of FIG. 5A. In FIG. 5B, a crank arm arrangement 250 is used. This arrangement is somewhat similar in its basic structure to the metering unit 30 disclosed in the first embodiment, the significant different being that no motor is used; instead the user rotates a crank arm 252 to cause the metering plate 240 to reciprocate. The metering plate 240 defines a lateral slot 248 contain an eccentric pin 258 affixed to a crank 256 affixed to the crank arm 252. By rotating the manual crank arm 252, the user can draw the metering plate 240 back and forth to meter tobacco from the hopper 20 to the compression chamber 90.

One skilled in the art will recognize that various bearings and supports can be used for the embodiments of FIGS. 5A and 5B.

III. Third Embodiment

Figure 6A:
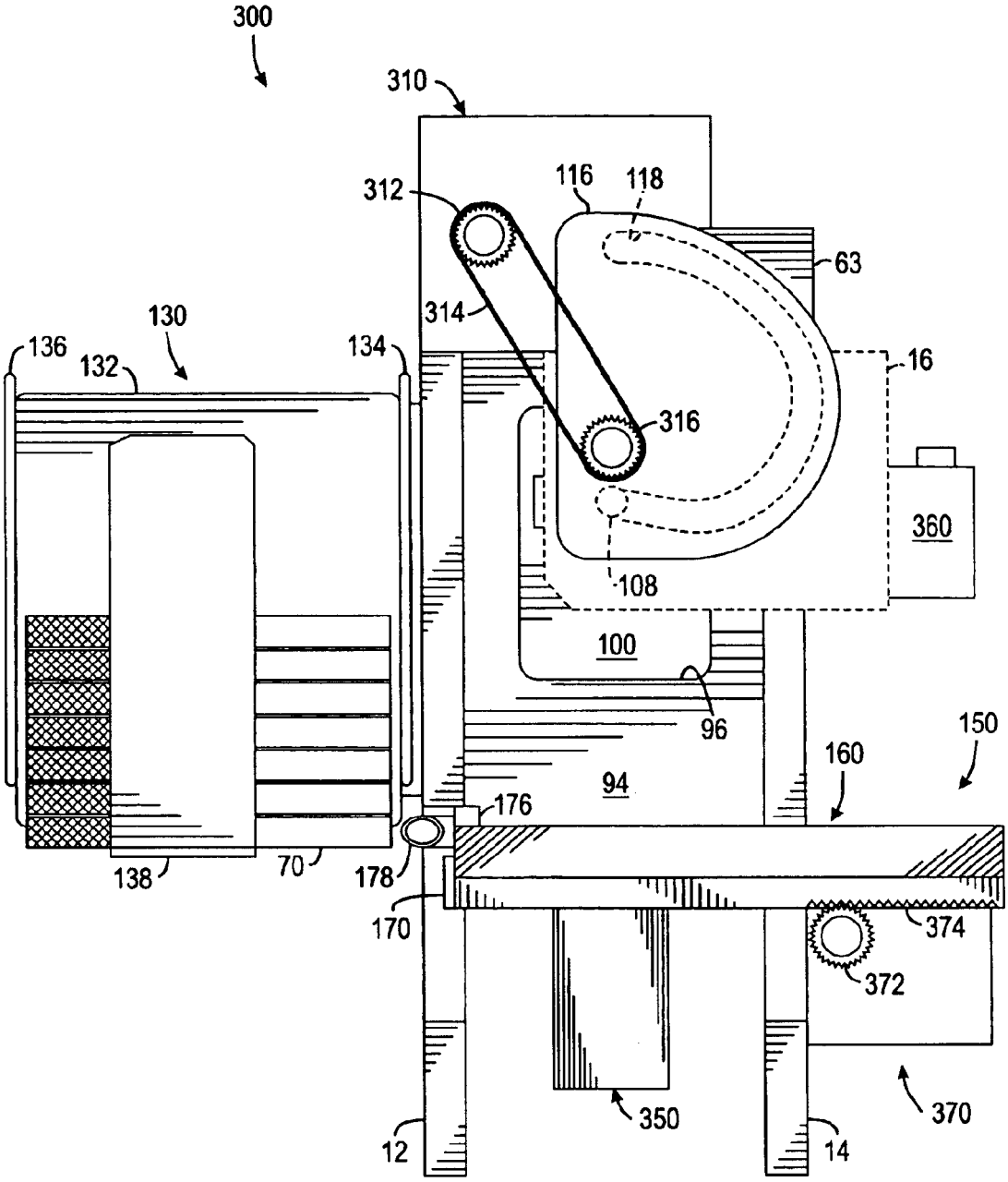
FIG. 6A illustrates a third embodiment of an automated device for filling cigarette tubes with metered amounts of tobacco.
Figure 6B:
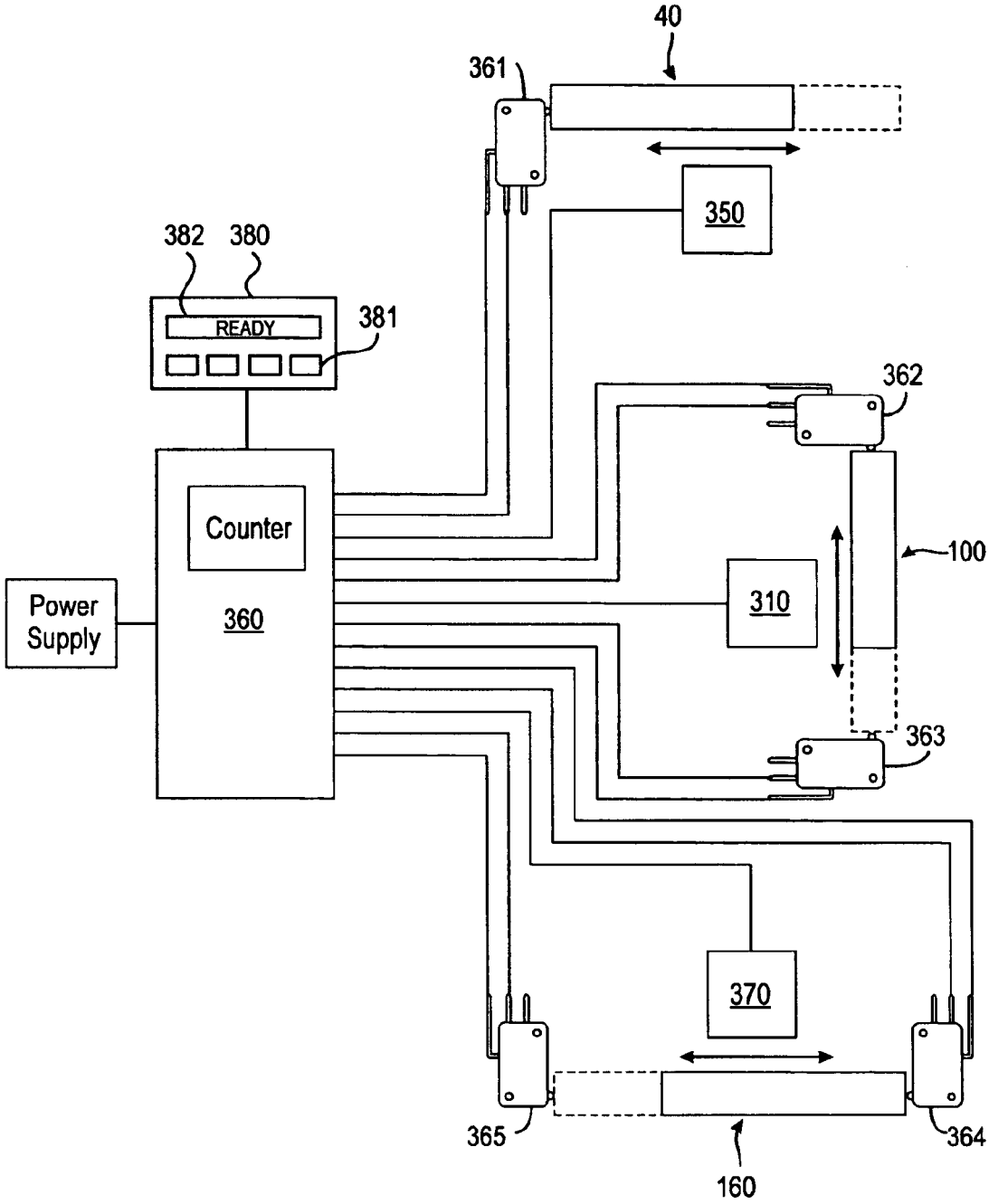
FIG. 6B illustrates a schematic of a control unit for the device of FIG. 6A.

FIGS. 6A–6B illustrate a third embodiment of a device 300 for filling cigarette tubes which is fully automated. Again, the same element numerals are used for substantially similar structures referenced earlier, which are not repeated here.

Device 300 includes a compression motor 310, a metering motor 350, an injection motor 370, and a control unit 360. Automated metering is substantially similar to that described with respect to the automated metering unit of the first embodiment, which is not reiterated here.

The components of the compression mechanism are also largely similar to those disclosed with respect to the first embodiment, except that the crank arm 112 has been replaced by compression motor 310 and a gearbox, which are not shown which are similar to those described previously, and which include a first gear shaft 312, a drive belt 314, and a second gear shaft 316. The motor and gearbox rotate the first gear shaft 312, which rotates the second gear shaft 316 with the drive belt 314. As the second gear shaft 316 is connected to the cam member 116, such rotation moves the compression member 100 and the clamp member 180 (FIG. 1B) as described previously. Specifically, rotating the gear shaft 312 in one direction causes compression of tobacco metered into the compression chamber, while rotation in the reverse direction causes the compression member 100 to engage the activation switch 62 (not shown) in housing 63.

As one skilled in the art will recognize, if the motor's shaft is connected directly to second gear shaft 316, first gear shaft 312 and drive belt 314 are not necessary. Moreover, although shown external to the housing for the device 300, the components of the compression mechanism can be configured to reside inside of the housing.

The injection motor 370 similarly includes a gearbox, which is not shown but which is similar to those described previously. The injection motor 370 includes a pinion 372, which intermeshes with teeth formed on a rack 374 attached to the shuttle 160. The motor and gearbox rotate the pinion 372, which in turn moves the rack 374 from left to right, i.e., towards or away from the cigarette tube magazine 130 as described previously. More specifically, by rotating the pinion 372 in one direction, the injection motor 370 moves the shuttle 160 toward the magazine 130 to inject previously-compressed tobacco into a waiting cigarette tube 70. Rotating the pinion 372 in a reverse direction returns the shuttle 160 to a position under the compression chamber 90.

Referring to FIG. 6B, an embodiment of the control unit 360 for the disclosed device 300 is schematically shown. The control unit 360 is capable of sequential operation and control of the metering motor 350, the compression motor 310, and the injection motor 370. A plurality of limit or contact switches 361–365 are used by the control unit 360 to determine the location of the metering plate 40, the compression member 100, and the shuttle 160 and to report such positions to the control unit 360. Although limit switches are used in the present embodiment of the control unit 360, one of ordinary skill in the art will readily recognize that a number of other position sensing devices known in the art can be used to sense or detect the location of the components. For example, Hall effect sensors, encoders, proximity switches, or optical switches can be used.

The control unit 360 is coupled to a power supply, which can be a battery source or a conventional commercial power source, and is coupled to the various switches and motors referenced earlier. Also typically present in the control unit 360 is an Application Specific Integrated Circuit (ASIC), a Programmable Logic Circuit (PLC), a microcontroller, or other similar non-integrated circuitry for receiving switch inputs and generating motor outputs, and which otherwise contains a suitable algorithm to run the metering, compression, and injection portions of the filling procedure in sequence. One preferable PLC used in the control unit is part number FP-e, distributed by Aromat Corporation of New Providence, N.J. As one skilled in the art will appreciate, should the integrated circuitry not be able to provide suitable current drive to drive the motors, a relay may be interposed as a switch between the outputs of the control unit 360 and the motors 310, 350, and 370 to pass DC regulated power to the motors. In any event, understanding the basic functions and sequences of events as disclosed herein, one skilled in the art can design such circuitry for the control unit 360 as a matter of course.

As before, the control unit 360 can have or be coupled to a user interface 380 comprising various input 381 such an on/off switch or various inputs such as buttons or a key pad, such as those used to select the quantity of tobacco to be placed in the cigarette as discussed earlier. The user interface may also include a LCD or dot matrix display 382 to provide the user instructions or otherwise inform the user of the status of the device or the filling operation. In its simplest embodiment, the user interface 380 need only comprise an on/off switch.

After affixing a tube 70 to the nozzle 178, the user selects at 381 the filling operation to be performed (e.g., to specify a "light" or "heavy" cigarette), or otherwise merely presses a button (e.g. an on/off switch) to perform a preset filling algorithm. At that point the counter in the control unit 360 is updated to define the number of metering strokes to be performed. (Alternatively, the control unit can be configured to perform metering strokes for a set period of time instead of a set number of strokes). The metering motor 350 is then activated to move the metering plate 40 back and forth. It is preferable prior to metering that the control unit 360 move the compression member 100 upward and shuttle 160 to the right (as shown), or otherwise verify that switches 362 and 364 are depressed to ensure that these components are in the right place and will not interfere with metering.

In one embodiment, when the counter sees that the switch 361 has been depressed by the specified number of strokes, the control unit 360 stops metering motor 350 and next activates the compression motor 310 to direct the compression member 100 (and clamping unit 180) downward. When this happens, switch 363 is depressed, and perhaps by first verifying that switch 364 has been depressed, the control unit 360 will then be signaled to engage the injection motor 370. At this point, the injection motor 370 moves the shuttle 160 to the left to inject the compressed tobacco plug into the waiting (and clamped) cigarette tube 70. The control unit will know that injection has occurred when it senses that switch 365 has been depressed. At that point, the control unit 360 initializes the device 300 for the next filling procedure by activating the motors 310 and 370 to move the compression member 100 and the shuttle 160 back to their starting positions.

One of ordinary skill in the art will appreciate that the motors must be capable of providing enough force or torque to move the components 40, 100, and 160 of the disclosed device 300 and/or to compress and inject the tobacco. Determination of sufficient capacities or ratings of motors, gearboxes, etc. would be a routine undertaking of one of ordinary skill in the art.

Although limit switches 361–365 are particularly useful, they may not be strictly necessary if motors 350, 310, and 370 constitute stepper motors or have encoders indicative of position and which can be interpreted by the control unit 360.

IV. Fourth Embodiment

Figure 7:
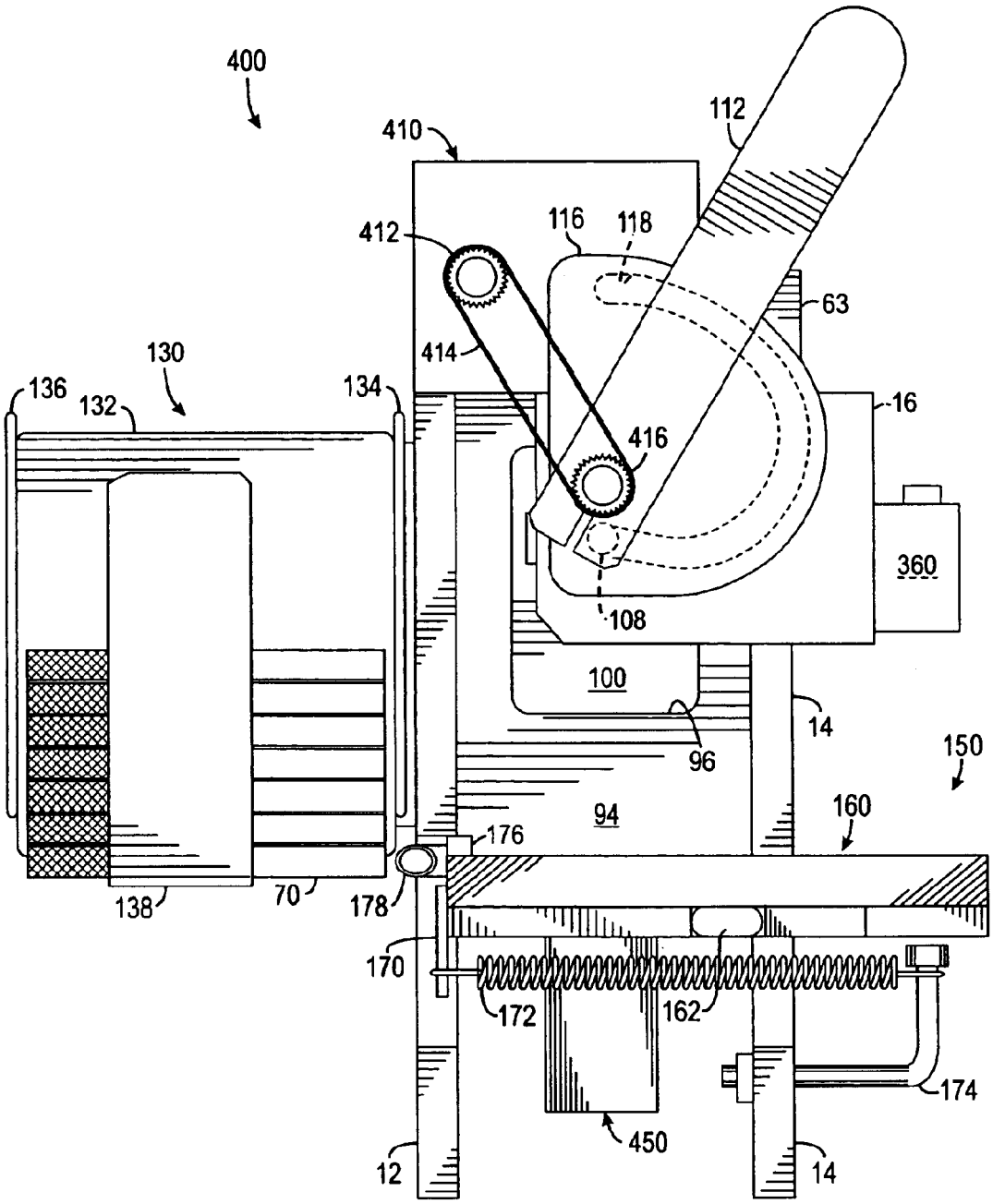
FIG. 7 illustrates a fourth embodiment of an automated device for filling cigarette tubes with metered amounts of tobacco.

Referring to FIG. 7, a fourth embodiment of a device 400 for filling cigarette tubes with metered amounts of tobacco is illustrated. Again, similar element numerals are used for similar components illustrated earlier.

As with the third embodiment, this fourth embodiment is capable of automated metering, automated compression, and automated injection of tobacco. However, this configuration provides a dual compression and injection motor 410 that performs both of these functions. Because the automated metering scheme and control unit 360 are similar to those described in earlier embodiments, they are not further discussed here.

The dual compression and injection motor 410 activates both the compressing unit 80 and the injecting unit 150, and preferably includes a gearbox, which is not shown but which may be similar to those described previously. As with the third embodiment, a first gear shaft 412, a drive belt 414, and a second gear shaft 416 are shown and which ultimately provide rotational movement to the second gear shaft 416. Such rotation rotates the cam member 116 to move the compression member 100 (and clamping unit 180) downward as described previously.

The cam member 116 has an arm 112 affixed to it as in the first embodiment, although this arm is not manually activated by the user. Instead, the arm 112 rotates by virtue of motorization of the second gear shaft 416, and after compression, comes into contact with trigger 162 to move the shuttle 160 to inject the tobacco as described earlier. In short, motor 410 performs both compression and injection in an automated fashion. Of course, this fourth embodiment also preferably has a control unit 360, which operates similarly to that described in the third embodiment, although simplified by virtue of this fourth's embodiment's two-step filling process (metering and compression/injection). (For example, and referring briefly to FIG. 6B, limit switches 363 and 364 might not be necessary in this fourth embodiment as it may only be necessary for the control unit 360 to know when the device is ready for metering (switch 362) and when injection is finished (switch 365)). Furthermore, as no manual activation is required, the moving components for this embodiment may all be made internal to the housing of the device 400.

V. Fifth Embodiment

Figure 8:
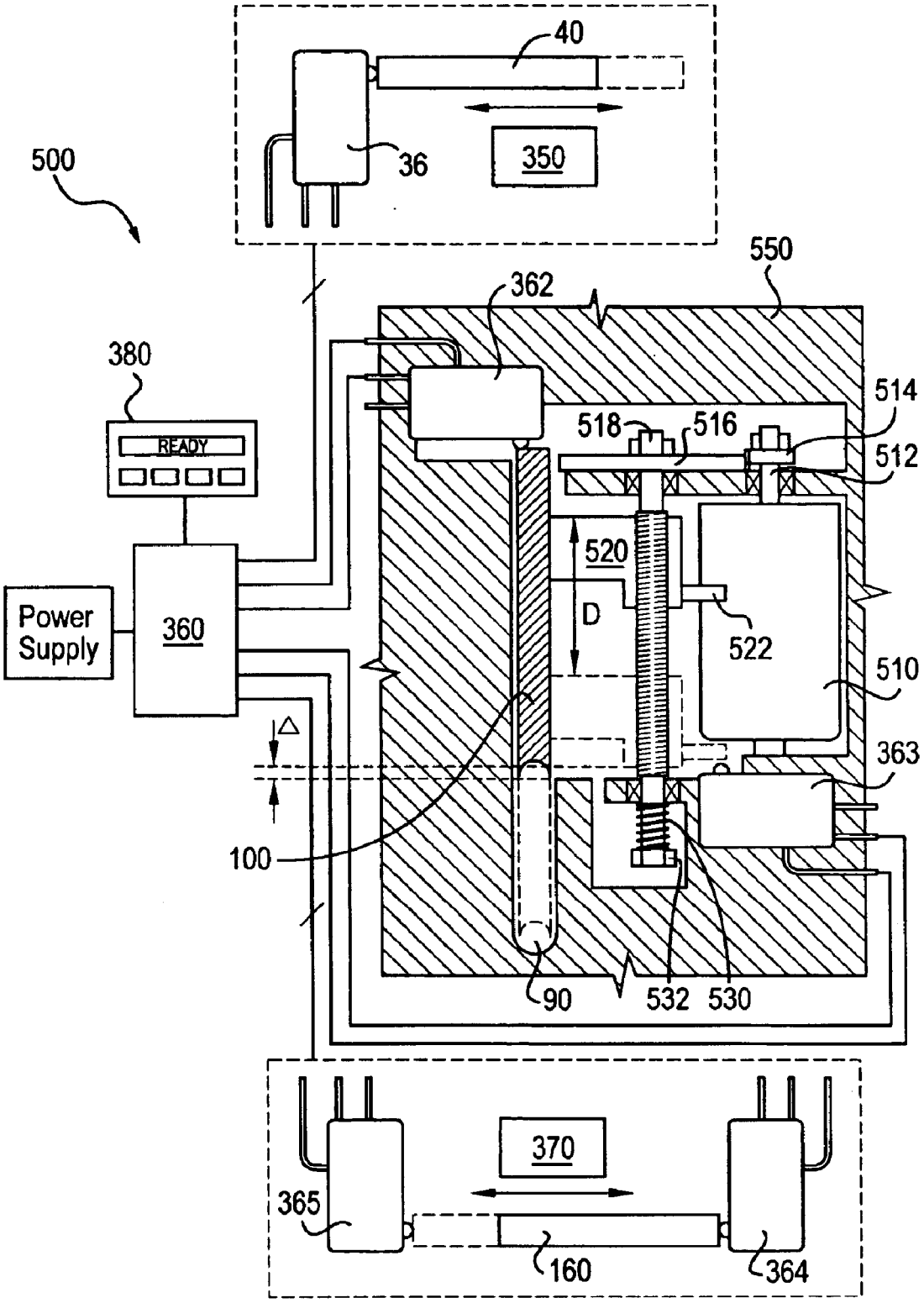
FIG. 8 illustrates a fifth embodiment of an automated device for filling cigarette tubes with metered amounts of tobacco capable of detecting the sufficiency of the quantity of metered tobacco and adjusting that quantity if necessary.

More sophisticated fully-automated approaches may also be employed. For example, FIG. 8 shows a fifth embodiment of a device 500 for filling cigarette tubes with metered amounts of tobacco. This embodiment is largely similar to the third embodiment illustrated earlier. More specifically, the metering and injection hardware, and the aspects of control unit 360, are similar in this embodiment, and again, similar elements numerals are used to describe components introduced earlier. However, in this fifth embodiment, the compression hardware and algorithm are modified to allow the amount of tobacco 76 being compressed to be sensed to assess whether it is adequate. If the amount of tobacco sensed is inadequate, further metering strokes are performed, and quantity is again assessed via compression, as will be described in more detail later.

In this fifth embodiment, the compression motor 510 is oriented differently as in the third embodiment: in the third embodiment the gear shaft 312 of the motor was horizontal, whereas the gear shaft 512 in this embodiment is vertical. A suitable motor 510 for this embodiment includes part number 8322S002, manufactured by Pittman of Harleysville, Pa.

Gear shaft 512 is coupled to a pinion 514, which meets in a meshed teeth relationship with drive gear 516. Drive gear 516 is in turn coupled to a drive screw 518. The gear shaft 512 and drive screw 518 are coupled to the housing 550, but contain bearings to allow them to rotate. (The housing 550 is merely illustrative and may consist of several different components in a commercial embodiment. One skilled in the art will recognize that there are many ways of mounting the various components within the housing 550, and that such components will contain various through holes to allow motion of the internal components). The shaft of the drive screw 518 is threaded as shown, and has a traveling nut 520 with internal threads screwed to the threads on the drive screw 518. The traveling nut 520 is rigidly affixed to the compression member 100, and indeed may be made integral therewith. The compression member 100 and traveling nut 520 are affixed in the housing 550 within grooves (only partially shown for clarity) to keep their horizontal positions constant, much in the same way as was discussed with respect to FIG. 3A. So configured, operation of the motor 510 turns gear shaft 512, which in turn turns the drive shaft 518, and which in turn allows the traveling nut 520 and compression member to move vertically within the housing 550 of the device 500.

When the motor 510 is operated, the compression member is capable of moving a maximum vertical distance of $D+\Delta$, which distance may be dictated by controlling the operation of the motor. This distance is also limited by a mechanical stop, such as the compression member 100 touching the compression chamber 90 or more likely the traveling nut 520's bottom touching the housing 550. When the nut 520 bottoms out against the housing, there is a possibility that the nut 520 will "bind" or "jam" against the housing, which is especially possible given that inertia of the drive shaft 518 will cause further tightening even after the motor 510 has shut off. To alleviate this problem, a spring 530 is positioned over the drive shaft 518, which is held is place between the housing 550 and a shaft collar 532 affixed to the drive shaft 518. When the nut 520 bottoms out against the housing, any further rotation of the drive shaft 518 will draw the shaft collar 532, and hence the drive shaft 518, upward by a small amount, which in turn will compress spring 530, and prevent binding of the nut 520.

In any event, $\Delta$ constitutes an overstroke distance, such that when the maximum distance of $D+\Delta$ is traversed by the compression member 100 and/or nut 520, the device 500 understands that not enough tobacco 76 (not shown) has been passed by the metering motor 350 to the compression chamber 90. This is understood by the device because traversing the maximum distance brings an actuator 522 on the traveling nut 520 into contact with the switch 363. In other words, when switch 363 is contacted, the control unit 360 understands that further metering of the tobacco is necessary to bring more tobacco to the compression chamber 90. (Of course, the control unit 360 must know when to query the status of the switch 363; this can be accomplished by knowing the time that it takes for the compression member 100 to traverse completely downward, and then programming the control unit 360 to query the switch 363 after the expiration of that time period). Accordingly, the control unit directs the compression member 100 upward, and the metering motor 350 is preferably activated for one additional metering stroke (although more than one stroke could be used). Thereafter, compression is again attempted through activation of motor 510. Should switch 363 again be contacted, additional metering is performed, and so on. Eventually, a sufficient amount of tobacco is metered into the compression chamber, and this additional bulk of tobacco prevents the compression member 100 from traversing the overstroke distance, Δ. (In fact, and assuming suitable limits to the motor 510's power, the motor 510 may stall). In other words, the compression member 100 eventually will only travel a distance of D, as shown in FIG. 8, which is not a sufficient distance to allow the actuator 522 to contact the switch 363. When this lack of contact of switch 363 is detected by the control unit 360, it understands that a suitable amount of tobacco has been metered, and accordingly that compression is now finished, and injection can begin through activation of the injection motor 370 as described earlier.

Thus, in this fifth embodiment, the device 500 can detect the amount of metered tobacco, and can adjust the amount of tobacco that is metered to ensure a suitable finished filled cigarette. Such an additional capability is especially beneficial when dealing with tobaccos of different cuts or consistencies, which may not meter at the same quantities per metering stroke, and therefore which may require adjustment by the device 500. Using dimensions for the metering system disclosed earlier, and as can be programmed in the control unit 360, it is preferred to initially perform five metering strokes, followed by compression and detection, followed if necessary by one additional metering stroke, followed again by compression and detection, and so on, until detection suggests a full compression chamber 90 ready for injection. However, this is not strictly necessary, and compression and detection can be performed after every metering stroke to simplify the algorithm, although of course initial metering strokes would be unlikely to provide a suitable amount of tobacco.

VI. Sixth Embodiment

Figure 9A:
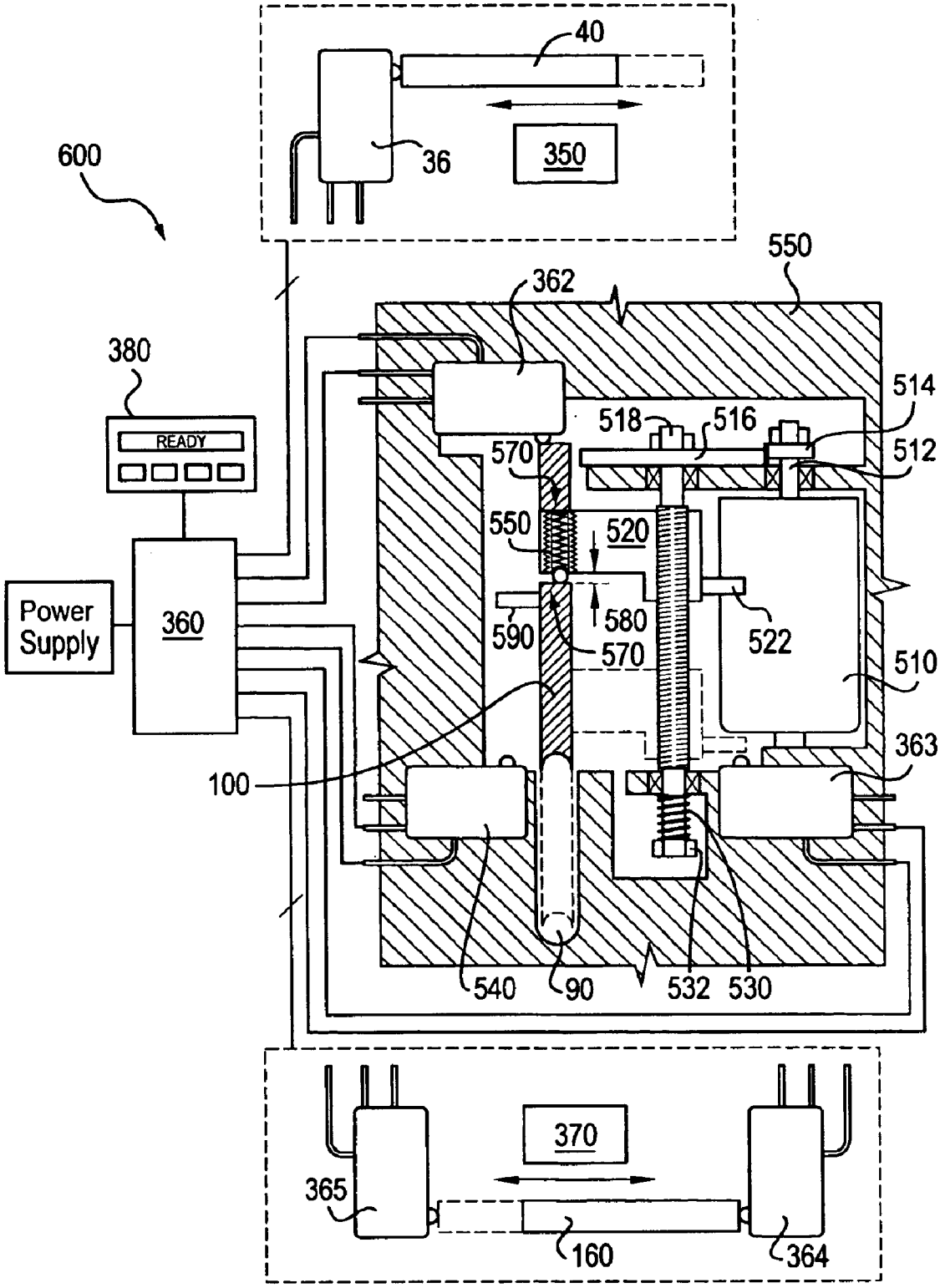
FIGS. 9A–9C illustrate a sixth embodiment of an automated device for filling cigarette tubes with metered amounts of tobacco having an improved capability for detecting the sufficiency of the quantity of metered tobacco and adjusting that quantity if necessary.

FIG. 9A depicts a sixth embodiment of a device 600 for filling cigarette tubes with metered amounts of tobacco which is similar in many respects to the fifth embodiment discussed above. However, this sixth embodiment contains additional intelligence for determining whether an adequate amount of tobacco has been metered to the compression chamber 90.

Figure 9B:
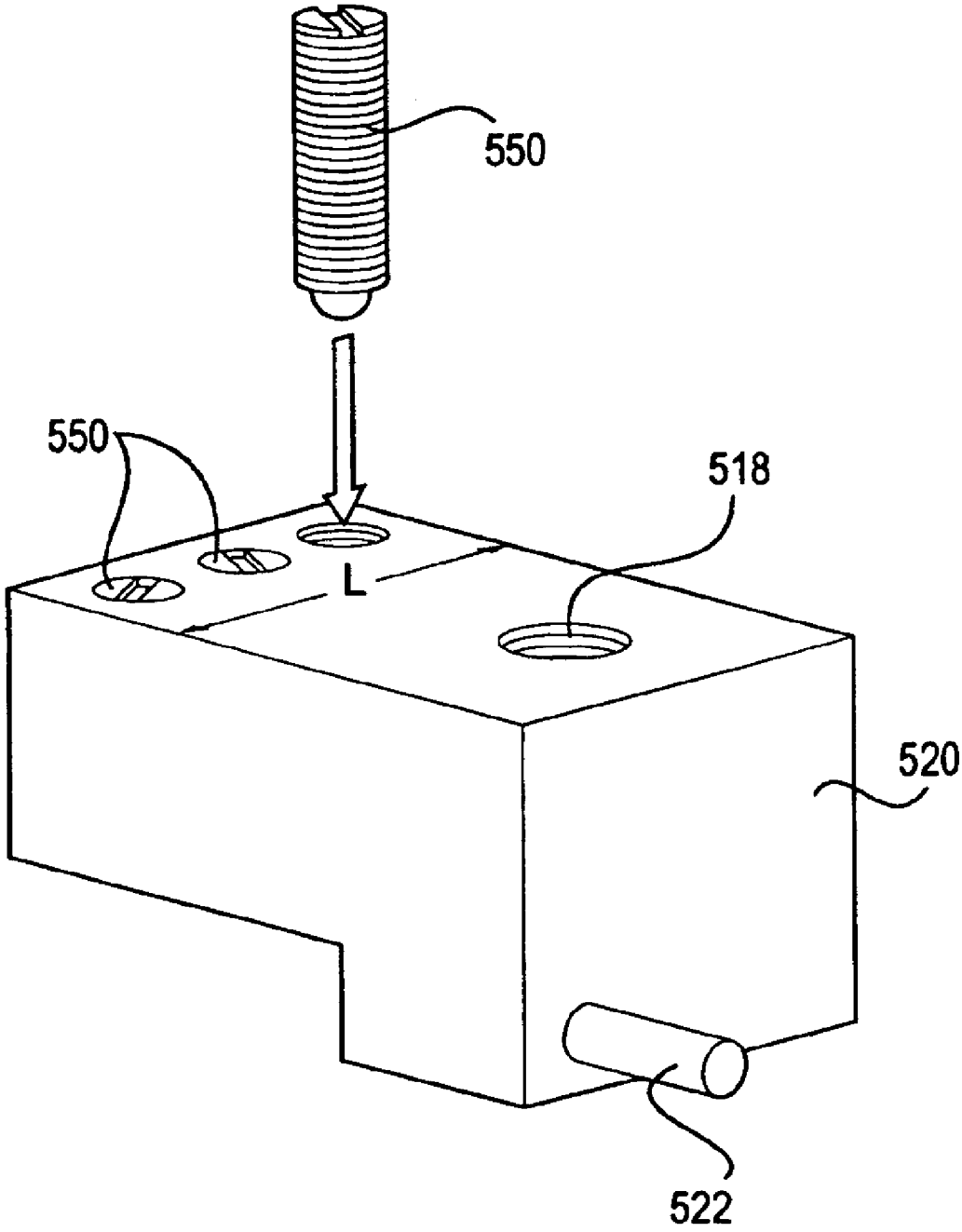

In FIG. 9A, an additional switch 540 is disclosed, which, in conjunction with switch 363, assists in determining whether an adequate amount of tobacco has been metered, or whether additional metering is needed as discussed above. In this sixth embodiment, the traveling nut 520 is not rigidly coupled to the compression member 100. Instead, it is coupled by spring loaded plungers 550. In one embodiment, the plungers 550 resemble set screws having threads on their outsides which can be screwed into the nut 520 as shown in FIG. 9B. The plungers 550 contain an internal springs coupled to ball noses at their bottoms which can be depressed to compress the internal springs. Suitable plungers 550 include part number LK-1A, supplied by Reid Tool Supply Company of Muskegon, Mich.

The traveling nut 520 complete with the plungers 550 are positioned within a slot 570 formed in the compression member 100. This causes the plungers 550 to compress, which biases the top of the nut 520 against the top edge of the slot 570, and which exposes a small gap 580 between the bottom of the nut 520 and the bottom edge of the slot 570. In a preferred embodiment, this gap 580 is approximately 0.03-inches, although other spacings can be used. Although not all details of the housing 550 are shown as explained above in conjunction with the fifth embodiment, it will be understood that portions of the housing 550 are used to confine the lateral movement of the compression member 100 and traveling nut 520, which keeps the two from disconnecting during operation.

The plungers 550, once assembled in the nut 520 and once the nut is assembled within the compression member 100, are accessible through holes milled in the compression member 100 (not shown) to allow the plungers 550's height to be adjusted by a screwdriver if necessary. Such an adjustment feature may be beneficial in determining the optimal position of the plungers 550 in a new device, but in a commercial embodiment, it is envisioned that the proper depths and heights for the plungers 550 will be determined, and hence that the springs can merely reside in pockets within the nut 520. Any deformable material exhibiting spring-like properties could also be used, in lieu of plungers 550, such as elastomers, rubber nubs, etc. As used in this disclosure, "springs" should be understood as inclusive of all materials exhibit such spring-like properties.

As shown in FIG. 9B, a plurality of plungers 550 are used which span along the center portion of the length of the compression member 100 to provide even feedback from the compression member 100 along its length, a feature whose reasons will be made clear shortly. The actual length, L, of the traveling nut 520 may be approximately 0.75-inch, compared to the approximately 2.7-inch length of the compression member 100.

As with the fifth embodiment, the disclosed configuration allows the traveling nut 520 to drive the compression member 100 downward to compress tobacco within the compression chamber 90, but allows the compression member 100 to shift upward a gap 580's worth relative to the traveling nut 520 should the load produced by the tobacco in the compression chamber 90 be great enough to overcome the compressive force of the plungers 550. Whether the tobacco load is sufficient for injection is determined by the interaction of a second actuator 590 and its associated switch 540, as shown in FIG. 9A. The actuator 590 is capable of contacting the switch 540 when the compression member 100 is fully extended downward by the motor 510, i.e., through overstroke distance D+Δ as described earlier. Simultaneously, driving the compression member 100 through the overstroke distance will cause actuator 522 to contact switch 363 as described in conjunction with the fifth embodiment, although in this sixth embodiment switch 363 is not used to make an assessment of sufficient tobacco quantity in the compression chamber 90; that is the purpose of switch 540. Instead, switch 363 is used to merely inform the control unit 360 that the compression member 100 is fully extended and hence that switch 540 can be queried to assess tobacco quantity.

Thus, when the compression member 100 is fully extended, the load of the tobacco in the compression chamber 90 on the compression member 100 will determine whether the quantity of metered tobacco was sufficient, or if further metering strokes are needed. If the quantity of tobacco is insufficient, the tobacco will not place a sufficient upward force on the compression member 100, which in turn will not create a sufficient enough force on the springs in the plungers 550 to cause the compression member 100 to shift a gap 580 upward relative to the nut 520. Instead, the nut 520 will remain pinned against the upper edge of slot 570, and the actuator 590 will be brought into contact with switch 540. The condition of the switches (363 contacted, 540 contacted) is thus interpreted by the control unit 360 as an insufficient tobacco condition, and further metering is performed as discussed above with reference to the fifth embodiment. Eventually, when the quantity of the tobacco is sufficient within the compression chamber 90, the force of the tobacco will be sufficient to cause compression of the springs in the plungers 550, and will cause the compression member 100 to shift a gap 580 upward relative to the nut 520, which will prevent actuator 590 from contacting switch 540. The condition of the switches (363 contacted, 540 not contacted) is thus interpreted by the control unit 360 as a sufficient tobacco condition, and therefore that the injection process can now begin.

This sixth embodiment, while more complicated than the fifth embodiment, is believed preferable because it reduces the possibility of the control unit 360 making an improper assessment of tobacco quantity. For example, assume that something in the device has jammed and that the compression member 100 is prevented from a full downward extension. If this happens, the fifth embodiment, after the time for switch 363 assessment has passed, would see that the switch 363 had not been pressed and hence would erroneously determine that an adequate amount of tobacco was present in the compression chamber 90, that compression was complete, and that injection could commence. However, in the sixth embodiment, the jam would prevent switch 363 from ever becoming depressed, which the control unit 360 (after some time) would interpret as a error, and hence would not bother to query the condition of switch 540.

Figure 9C:
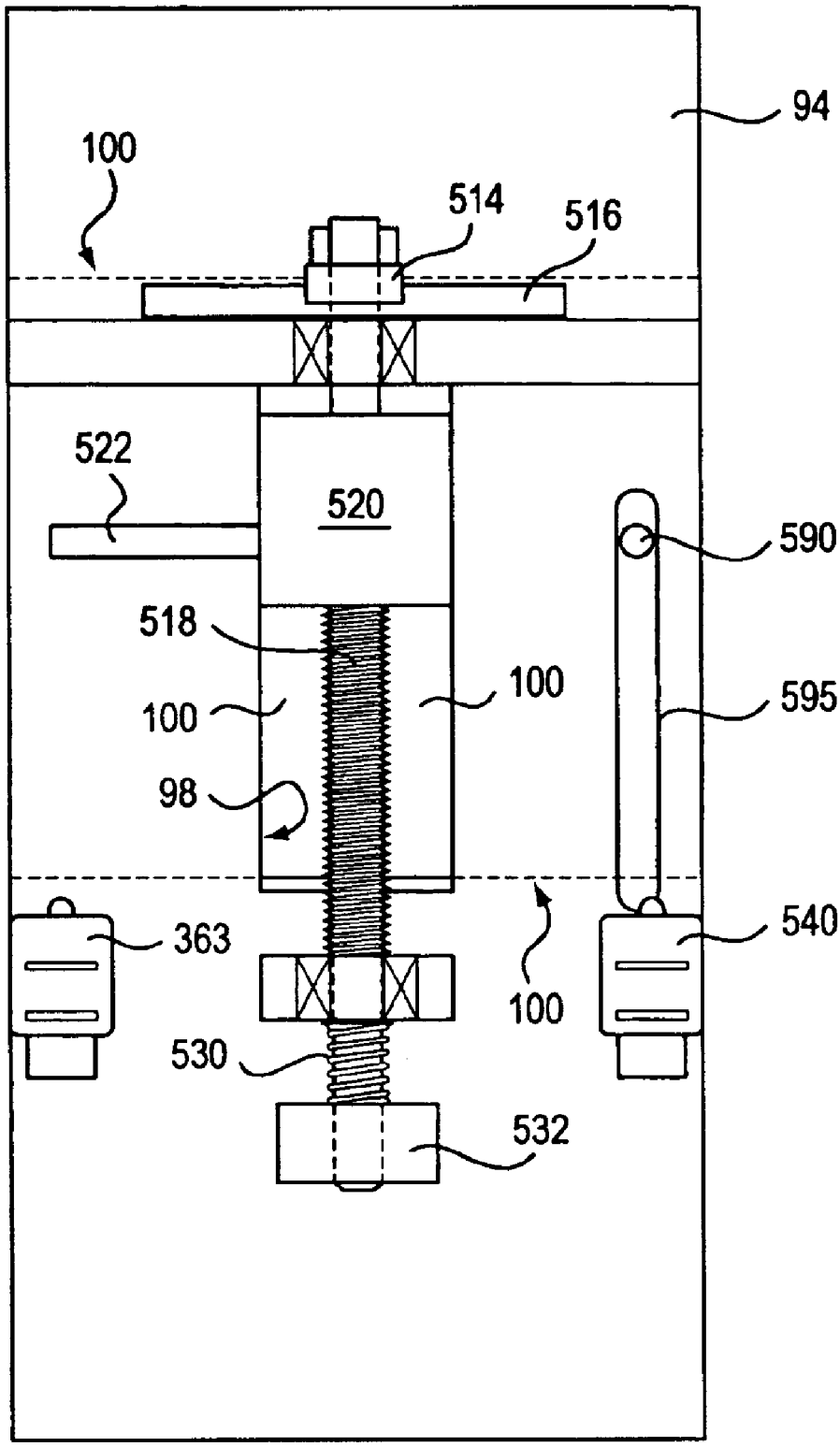

One skilled in the art will recognize that there are many different ways to mechanically configure the components of the device 600 to achieve the functionality described herein. For example, and as shown in FIG. 9C, which shows a plan view of the nut 520 and associated hardware with the motor 510 removed, the switches 363 and 540 could be placed at opposing edges and on the same side of the compression member 100, instead of at opposing sides as shown in FIG. 9A. In such a modification, the actuators 522 and 590 can be placed perpendicularly with respect to each other. Moreover, and as shown in FIG. 9C, the actuator 590 can be positioned through a hole 595 in one of the walls 94 (see FIG. 1C) which bind the compression member 100. (The compression member 100, which is behind the wall 94 in this view, is shown in dotted lines). Also shown in FIG. 9C is an opening 98 in the wall 94 though which the nut 520 communicates with the compression member 100, and which is analogous to the opening 98 shown in FIGS. 1A and 1C.

VII. Seventh Embodiment

In a seventh embodiment of a device 700 for filling cigarette tubes with metered amounts of tobacco, metering and compression are automated and combined into a single operation and are controlled by a single motor. This seventh embodiment, while similar in nature to the fifth and sixth embodiments in its ability to adjust tobacco quantity, is thus simpler and perhaps cheaper to implement as it does not require the additional complexity of three motors. Instead, only two motors are required: one to meter and compress, and one to inject.

Figure 10A:
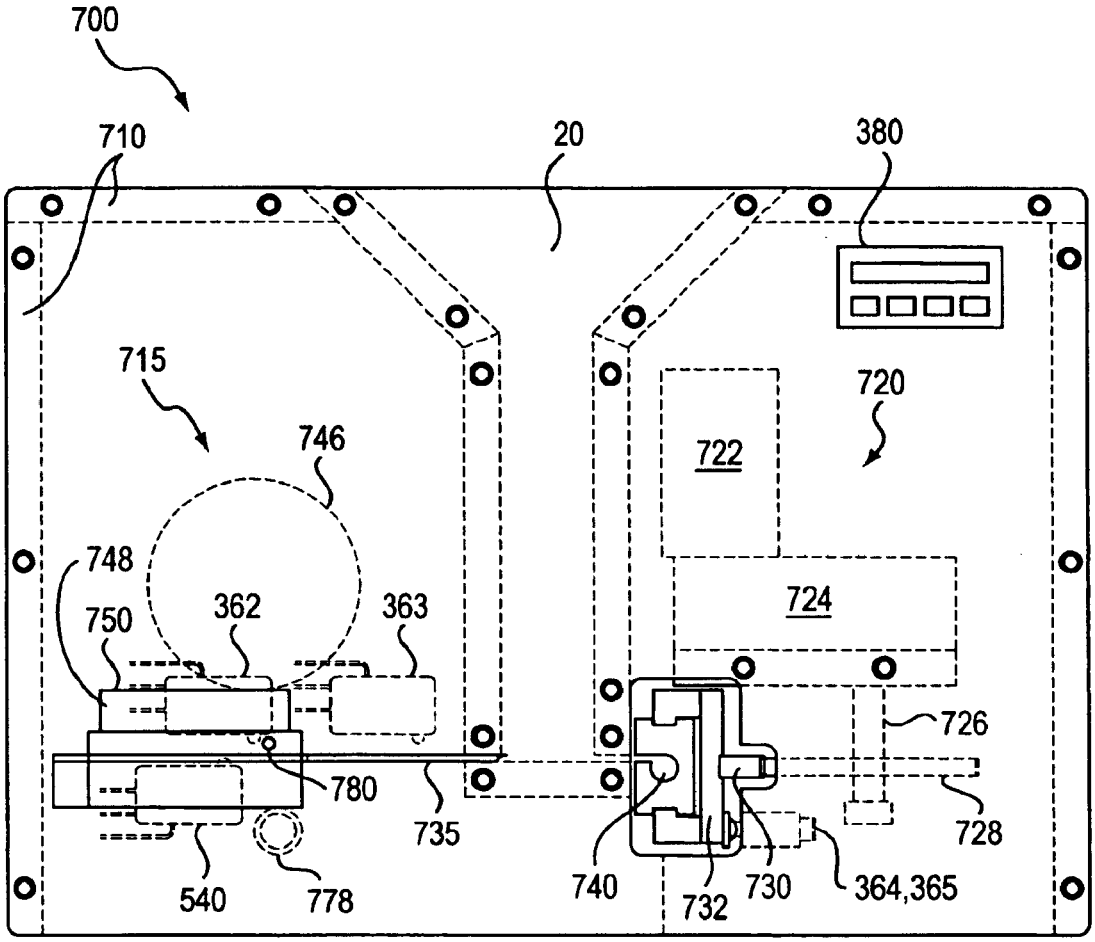
FIGS. 10A–10B illustrate a seventh embodiment of an automated device for filling cigarette tubes with metered amounts of tobacco in which metering and compression are integrated.
Figure 10B:
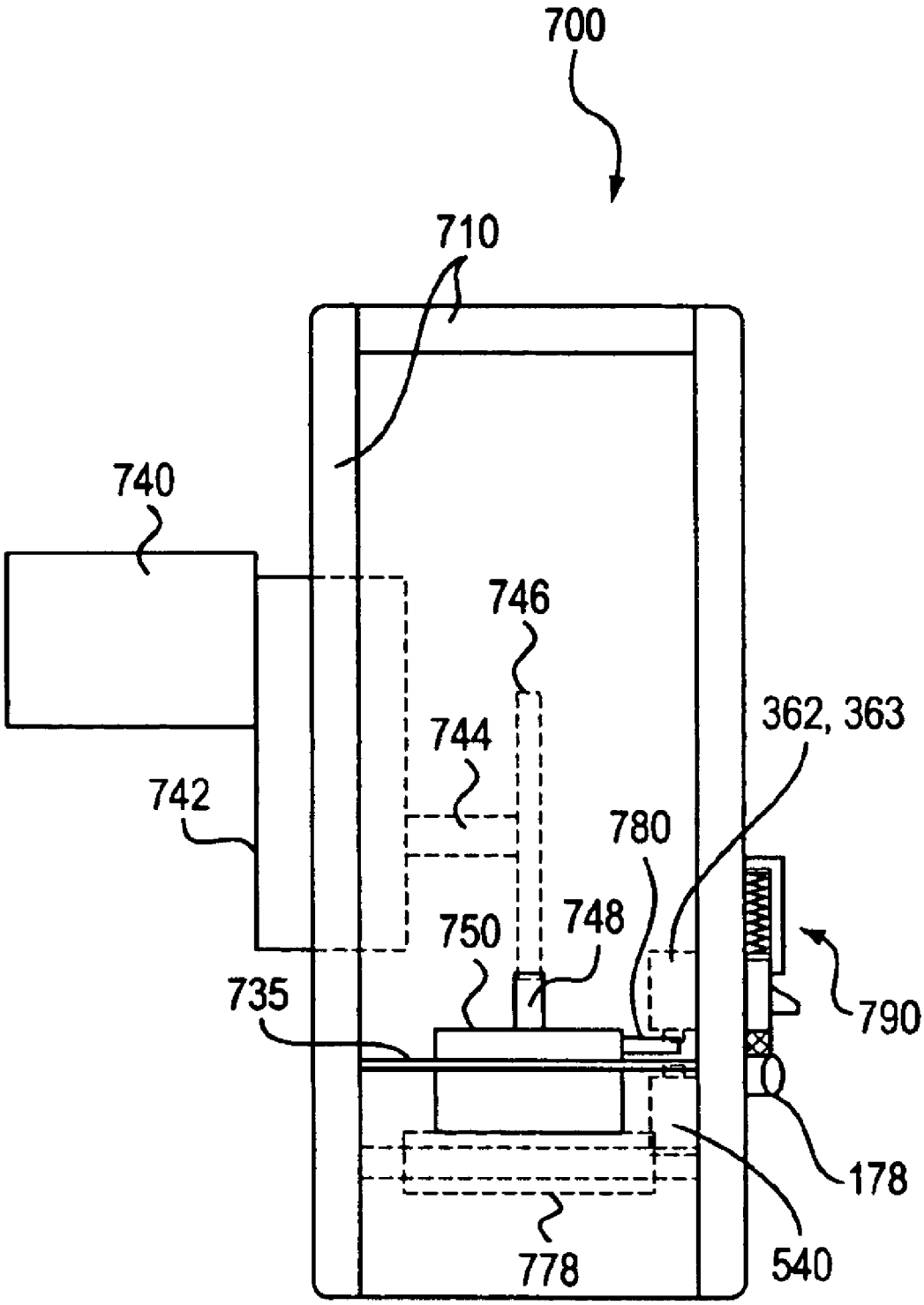

The basic structure of device 700 is shown in FIGS. 10A–10B which respectively show side and end views of the device. Certain internal structural members have been omitted so as not to obfuscate important operative components, but one skilled in the art will understand that such additional structures will be present in a commercial device. Appropriate housing structures 710 can be made of any suitable materials such as metal or plastic. The hopper 20 for holding the tobacco 76 (not shown) is formed in the center of the device, and may have suitable downward tobacco biasing means as described earlier. Also shown in FIG. 10A are the user interface 380 portion of the control unit 360 which was described earlier, a metering/compression section 715, and an injection section 720. Also shown in FIG. 10B is the nozzle 178 onto which a cigarette tube 70 to be filled is affixed (tube magazine 130 not shown for convenience), and a hand-operated, spring-based elastomer-tipped gripping member 790 for holding the cigarette tube firmly to the nozzle 178.

Although the primary feature of interest in this seventh embodiment is in the metering/compression section 715, the injection section 720 is first discussed. The injection section 720 includes a motor 722 whose rotor is connected to a gear box 724 having a drive shaft 726. A combination motor/gear box product suitable for use in this regard is part number CHM-2445-IM, manufacture by Molon Motor and Coil Corporation of Rolling Meadows, Ill. The drive shaft 726 drives a gear 728 having teeth meshing with teeth on a rack 730 on an injection shuttle 732, which is similar to the injection shuttles disclosed earlier, although in this embodiment the shuttle 732 is rotated at 90 degrees. To track the end point positions of the shuttle 732, switches 364 and 365 are again used as in earlier embodiments. As one skilled in the art will understand, various adaptors can be used with the drive shaft 726 if necessary to couple it to the gear 728 and/or to allow the gear 728 to slip should the shuttle 732 become jammed. Otherwise, the injection section 720 and related components are similar to those discussed in earlier embodiments.

The basic scheme of the metering/compression section 715 is to pass a metering/compression member 735 across the bottom of the hopper 20 to meter tobacco to a compression chamber 740 and to use the same member 735 to compress the tobacco in the chamber 740 at the end of its stroke. In this regard, the metering/compression section 715, like the injector section 720, includes a motor 740, gear box 742, a drive shaft 744, a gear 746, and may also constitute Molon part number CHM-2445-IM disclosed above. The gear 746 contains teeth which mesh with teeth on a rack 748 which is rigidly coupled to a traveling shuttle 750. The traveling shuttle 750 is similar to the traveling nut 520 disclosed in the fifth and sixth embodiments in that it ultimately drives the metering/compression member 735, and may do so through a rigid coupling between the two (as in the fifth embodiment) or with a spring-biased coupling (as in the sixth embodiment). Illustrated herein is a spring-biased coupling arrangement, which, as noted earlier with respect to the sixth embodiment, provides better intelligence to the control unit 360 concerning whether adequate amounts of tobacco have been metered and whether injection can commence.

The metering/compression member 735 and its associated traveling shuttle 750 are shown in further detail in FIGS.

Figure 10C:
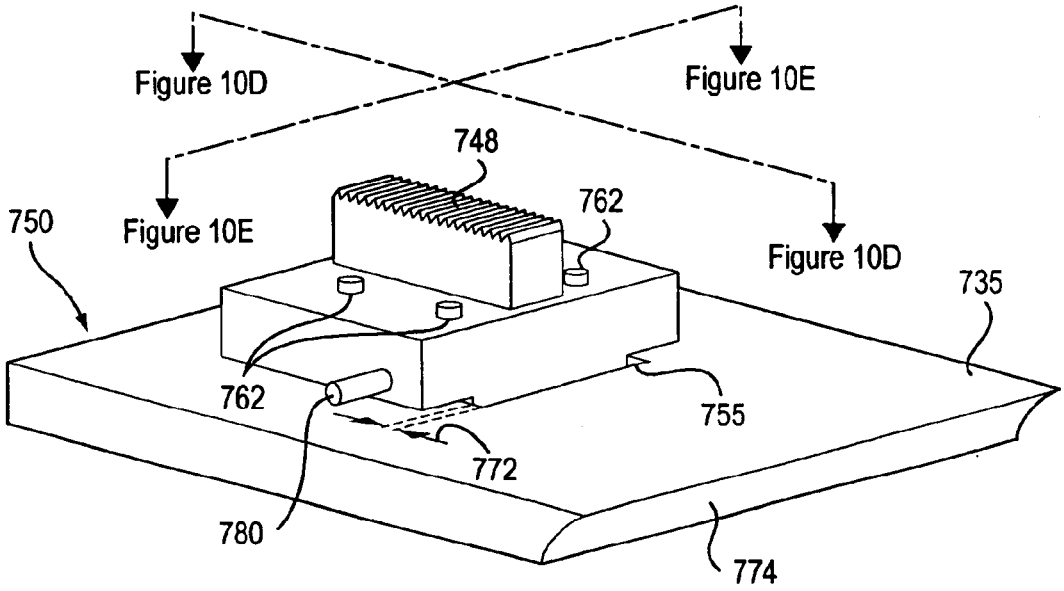
FIGS. 10C–10E illustrate details of a metering/compression member useable with the seventh embodiment.
Figure 10D:
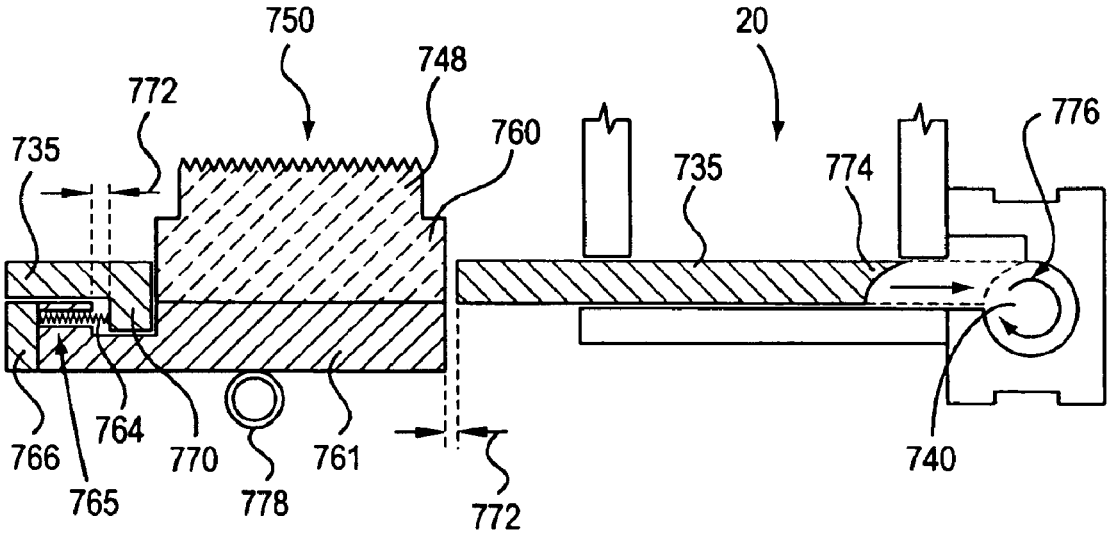
Figure 10E:
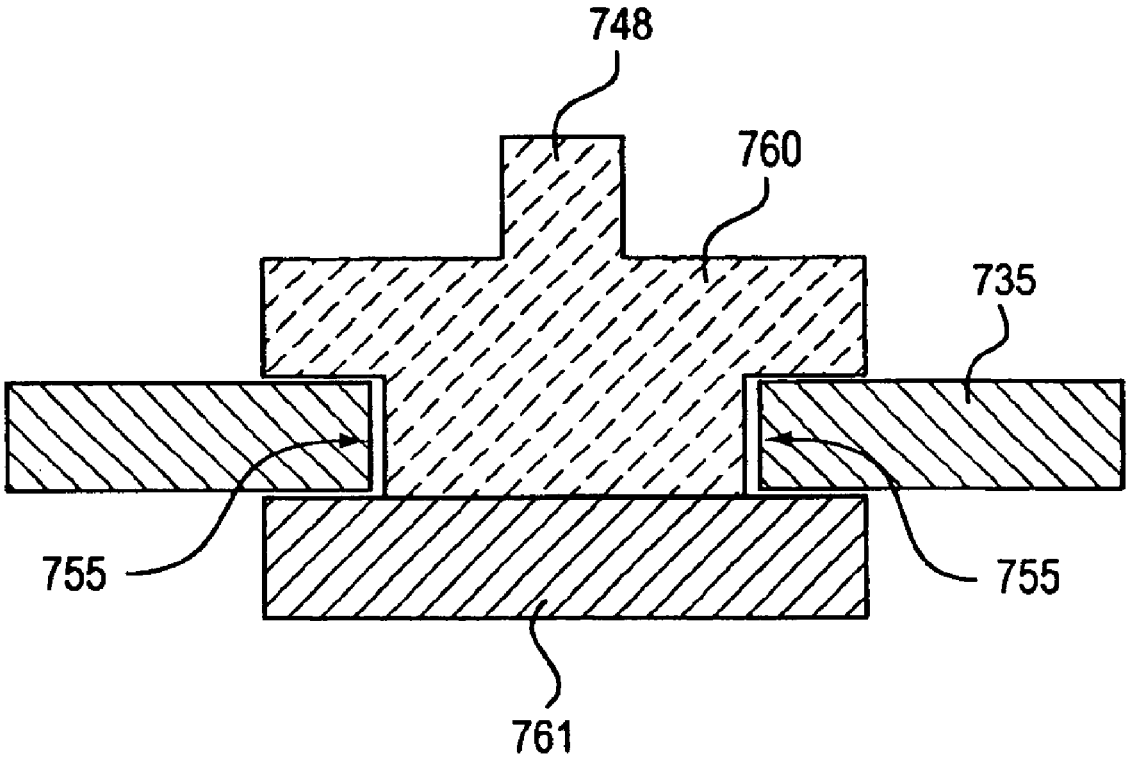

10C–10E. The metering/compression member 735 is preferably formed of metal and has a rectangular opening 755 formed therethrough to accompany the traveling shuttle 750. The traveling shuttle 750 is preferably formed of upper 760 and lower 761 pieces (FIG. 10E) affixed to each other by bolts 762 (FIG. 10C) or by other suitable fastening means. The upper 760 and lower 761 pieces may themselves be formed of other pieces affixed together, or may be forged or milled as shown; they are shown as solid integral pieces for simplicity. The upper piece 760 includes the rack 748 introduced earlier. As best seen in FIG. 10D, the lower piece 761 accompanies springs 764, which are similar in function to plungers 550 disclosed and discussed with respect to the sixth embodiment. Although only one spring 764 is shown, three springs are preferably used spanning partially across the width of the metering/compression member 735. The springs 764 appear in pockets 765 formed in the lower piece 761, which may be formed by milling holes in the piece 761, and then affixing a solid sub-piece 766 to the back of the holes as shown. As best shown in FIG. 10E, the width of the upper 760 and lower 761 pieces is wider than the opening 755 formed in the metering/compression member 735, such that when the two are bolted together (762), the member 735 will be confined therebetween. However, because the member 735 must be able to reciprocate between the two pieces 760, 761 of the traveling shuttle 750 as described below, the thicknesses of the various pieces are adjusted to allow such freedom of movement.

As best shown in FIG. 10D, the metering/compression member 735 is formed with a ledge 770 along its lower surface. The springs 764 are biased against this ledge 770. Because the metering/compression member 735 is moveable within the traveling shuttle 750, the effect of this spring bias is to push the shuttle 750 toward the left edge of the opening 755 formed in the member 735 as shown. Because the length of traveling shuttle 750 is slightly smaller than the length of the opening 755, such bias causes a gap 772 to form between the right edge of the opening 755 and the traveling shuttle 750, which is approximately 0.07-inches. However, because the traveling shuttle is held firm relative to the housing 710 by virtue of its connection to gear 746 (FIG. 10A), when a force is experienced on the right edge of the member 735, the bias of springs 764 can be overcome, and the member 735 will shift towards the left, which closes gap 772 on the right side of the opening 755 and reestablishes it on left side of the opening 755. In other words, and depending of the load experienced by the member 735, the member 735 can reciprocate from left to right relative to the traveling shuttle 750 through a gap 772's length, a property which is useful to assessing whether a suitable amount of tobacco has been compressed in the compression chamber 740, as will be explained below.

The compression chamber 740, best shown in FIG. 10D, is in this seventh embodiment essentially cylindrical in shape. When the metering/compression member 735 is set in motion by gear 746, a semi-cylindrical leading edge 774 of the member 735 is drawn from left to right through the bottom of the hopper 20, thus collecting tobacco and moving it to the compression chamber 740. Once the member 735 reaches its overstroked or fully extended condition (as described earlier), this leading edge is 774 brought to (or when overstroked, preferably slightly passed) a gap 776 formed in the upper cylindrical surface of the compression chamber 740 to essentially complete the chamber 740's cylindrical surface and to define a cylindrical compressed plug of tobacco suitable for injection. Although not strictly necessary, it is preferable to form the gap 776 in an upper portion of the chamber 740, and most preferably from 270 to 360 degrees. In this way, when tobacco is moved into the chamber 740, no tobacco gap will be formed in the top of the chamber 740, and instead, the tobacco will gradually be encouraged to move clockwise within the chamber as depicted by the arrow in FIG. 10D. In short, formation of the gap 776 and leading edge 774 in this manner ensures that a complete and cylindrical plug of tobacco is formed. Moreover, the sharpness of the top of the leading edge 774 also assists in shedding or cutting the tobacco prior to entry into the chamber 740, and thus the use of a scalloped edge (disclosed earlier) is not necessary. To further ensure proper cutting of tobacco as it passes from the hopper 20 to the compression chamber 740, the front wall 791 of the hopper 20 can be formed with a bladed shape (not shown).

As best shown in FIGS. 10A and 10D, a roller 778 rotatably affixed to the housing 710 provides support to the traveling shuttle 750, and ultimately metering/compression member 735, while still permitting these components to move horizontally within the device 700.

The metering/compression process in this seventh embodiment is similar in nature to that used in the sixth embodiment and uses a similar switch arrangement to assess the adequacy of the quantity of tobacco in the compression chamber 740; hence, the switches used are labeled with the same element numerals. More specifically, and referring to FIG. 10A, three switches are used for metering/compression: switch 362 informs the control unit 360 when the traveling shuttle 750 is at its home or fully retracted position (to the left in FIG. 10A); switch 363 informs the control unit when the shuttle 750 is fully extended (to the right in FIG. 10A); and switch 540 assesses tobacco load to either inform the control unit that further metering is necessary or that injection can commence. Switches 362 and 363 are activated by an actuator 780, which is most easily seen in FIG. 10C. As seen in FIGS. 10A and 10B, this actuator 780 interacts with the contacts on these switches as the shuttle 750 slides between its fully retracted and fully extended positions, thus informing the control unit 360 when these end points have been reached.

The contact on switch 540, by contrast, is activated by the metering/compression member 735 itself, as best seen in FIGS. 10A and 10B. More specifically, and assuming negligible tobacco load in the compression chamber 740, switch 540 is positioned within the housing so that its contact is always depressed by the member 735 passing overhead, except when the member 735 is at it fully extended (right most) position. Even more specifically, when fully extended, the contact on switch 540 is at most a gap 772's length away from the left edge of the member 735. So positioned, the switch 540 can determine whether the quantity of tobacco in the compression chamber 740 is sufficient. If the quantity is not sufficient, no or little load will be placed by the tobacco on the member 735, and the springs 764 (FIG. 10D) between the member 735 and traveling shuttle 750 will not appreciably compress. As a result, the member 735 will not shift to the left relative to the shuttle 750, and the contact on switch 540 will not be depressed. If the quantity is sufficient, sufficient load will be placed by the tobacco on the member 735 to compress the springs 764 between the member 735 and traveling shuttle 750. As a result, the member 735 shifts to the left relative to the shuttle 750, which allows the left edge of the member 735 to remain engaged with the contact on switch 540. Accordingly, the control unit 360 interprets the switches as follows: when switch 363, is depressed, the control unit knows that the traveling shuttle 750 is fully extended and that it is appropriate to query the status of switch 540; if switch 540 is not depressed, further metering is necessary and the member is retracted for (at least) an additional metering stroke; if switch 540 is depressed, further metering is not necessary, and injection can begin.

Because metering and compression are performed by the same member 735 in this embodiment, the algorithm employed by the control unit 360 is simplified. For example, there is no reason for control unit 360 to initially perform some pre-set amount of metering strokes, and only later start assessing the adequacy tobacco quantity as discussed above with reference to the fifth and sixth embodiments. In this embodiment, every stroke of member 735 can perform the quantity assessment by querying the status of switch 540, even though obviously the first strokes are unlikely to have moved a sufficient quantity of tobacco.

VIII. Conclusion

The foregoing embodiments show several different configurations of devices for filling cigarette tubes with metered amounts of tobacco, which are either fully manual, partially automatic, or fully automatic. Certain features, details, and configurations were disclosed in conjunction with each embodiment. However, one skilled in the art will understand that such features, details, and configurations can be used with the various different embodiments, even if such features, details, and configurations were not specifically mentioned in conjunction with a particular embodiment, and that this disclosure contemplates various combinations of the features, details, and configurations disclosed herein. More specifically, it is intended that such features, details, and configurations are covered by this patent to the extent that they come within the scope of the following claims or the equivalents thereof.

What is claimed is:

1. A method for filling a cigarette tube with tobacco, comprising not necessarily in sequence:

metering loose tobacco from a hopper to a compression chamber;

compressing the loose tobacco in the compression chamber; and injecting the compressed tobacco from the compression chamber to a cigarette tube in communication with the compression chamber, wherein the metering, compressing and injecting steps are respectively automated by a metering motor, a compression motor, and an injection motor.

2. The method of claim 1, further comprising assessing the status of a first switch during compression to determine whether a sufficient quantity of tobacco has been compressed in the compression chamber.

3. The method of claim 2, further comprising assessing the status of a second switch to determining whether the compression is complete.

4. The method of claim 3, further comprising querying the first switch only after the second switch has been engaged.

5. The method of claim 1, wherein compression is performed by a compression member moveable along a first axis, and wherein the compression member is coupled to the compression motor by a spring which allows the position of the compression member to vary along the first axis in response to a load provided by compressing the tobacco.

6. The method of claim 5, wherein the variance in the position of the compression member in response to the load selectively changes the status of a first switch.

7. The method of claim 6, further comprising assessing the status of a second switch to determining whether the compression is complete.

8. The method of claim 7, further comprising querying the first switch only after the second switch has been engaged.

9. The method of claim 1, further comprising determining whether a sufficient quantity of tobacco has been compressed in the compression chamber.

10. The method of claim 1, wherein the metering and compression steps are performed in alternating fashion prior to the injection step.

11. The method of claim 1, further comprising determining whether a sufficient quantity of tobacco has been compressed in the compression chamber during each compression step.

12. The method of claim 1, further comprising automating the metering, compression, and injecting steps in accordance with an algorithm.

13. The method of claim 12, wherein the algorithm further assesses whether a sufficient quantity of tobacco has been compressed in the compression chamber.

14. The method of claim 13, wherein the algorithm provides for an additional metering step if an insufficient quantity of tobacco has been assessed.

15. The method of claim 1, wherein the metering step comprises reciprocation of a metering member through a plurality of strokes using the metering motor.

16. The method of claim 1, wherein the tobacco is metered along a first axis, the tobacco is compressed along a second axis, and the tobacco is injected along a third axis, and wherein first, second, and third axes are all orthogonal to each other.

17. The method of claim 1, wherein the compression step further comprises affixing the cigarette tube in communication with the compression chamber.

18. The method of claim 1, further comprising, prior to the metering, compression, and injection steps, affixing the cigarette tube in communication with the compression chamber.

19. The method of claim 1, further comprising biasing the loose tobacco downward in the hopper.

20. The method of claim 1, wherein the tobacco is injected only after verification that the compressed tobacco in the compression chamber is of a suitable quantity.

21. A method for filling a cigarette tube with tobacco, comprising not necessarily in sequence:

metering loose tobacco from a hopper to a compression chamber;

compressing the loose tobacco in the compression chamber;

determining whether a sufficient quantity of tobacco has been compressed in the compression chamber; and injecting the compressed tobacco from the compression chamber to a cigarette tube in communication with the compression chamber.

22. The method of claim 21, wherein determining whether a sufficient quantity of tobacco has been compressed in the compression chamber further comprises assessing the status of a first switch during compression.

23. The method of claim 22, further comprising assessing the status of a second switch to determine whether the compression is complete.

24. The method of claim 23, further comprising querying the first switch only after the second switch has been engaged.

25. The method of claim 21, wherein the metering, compressing, and injecting steps are respectively automated by a metering motor, a compression motor, and an injection motor.

26. The method of claim 25, wherein compression is performed by a compression member moveable along a first axis, and wherein the compression member is coupled to the compression motor by a spring which allows the position of the compression member to vary along the first axis in response to a load provided by compressing the tobacco.

27. The method of claim 26, wherein the variance in the position of the compression member in response to the load selectively changes the status of a first switch.

28. The method of claim 27, further comprising assessing the status of a second switch to determine whether the compression is complete.

29. The method of claim 28, further comprising querying the first switch only after the second switch has been engaged.

30. The method of claim 21, wherein the metering and compression steps are performed in alternating fashion prior to the injection step.

31. The method of claim 21, further comprising determining whether a sufficient quantity of tobacco has been compressed in the compression chamber during each compression step.

32. The method of claim 21, further comprising automating the metering, compression, and injecting steps in accordance with an algorithm.

33. The method of claim 32, wherein the algorithm further assesses whether a sufficient quantity of tobacco has been compressed in the compression chamber.

34. The method of claim 33, wherein the algorithm provides for an additional metering step if an insufficient quantity of tobacco has been assessed.

35. The method of claim 21, wherein the metering step is automated.

36. The method of claim 21, wherein the metering step comprises reciprocation of a metering member through a plurality of strokes.

37. The method of claim 36, wherein the metering member is moveable by a motor.

38. The method of claim 36, wherein the metering member is moveable by a rotating crank arm.

39. The method of claim 21, wherein the tobacco is metered along a first axis, the tobacco is compressed along a second axis, and the tobacco is injected along a third axis, and wherein the first, second, and third axes are all orthogonal to each other.

40. The method of claim 21, wherein the compression step further comprises affixing the cigarette tube in communication with the compression chamber.

41. The method of claim 21, further comprising, prior to the meeting, compression, and injection steps, affixing the cigarette tube in communication with the compression chamber.

42. The method of claim 21, further comprising biasing the loose tobacco downward in the hopper.

43. The method of claim 21, wherein the metering and compression steps are both performed using a first member.

44. The method of claim 43, further comprising automating the movement of the first member and automating the injection step.

45. The method of claim 44, further comprising assessing the status of a first switch during compression to determine whether a sufficient quantity of tobacco has been compressed in the compression chamber.

46. The method of claim 45, further comprising assessing the status of a second switch to determine whether the compression is complete.

47. The method of claim 46, further comprising querying the first switch only after the second switch has been engaged.

48. The method of claim 44, wherein compression is performed by the first member moving along a first axis, and wherein the first member is coupled to a motor by a spring which allows the position of the first member to vary along the first axis in response to a load provided compressing the tobacco.

49. The method of claim 48, wherein the variance in the position of the first member in response to the load selectively changes the status of a first switch.

50. The method of claim 49, further comprising assessing the status of a second switch to determine whether the compression is complete.

51. The method of claim 43, further comprising recriprocating the first member through a plurality of strokes.

52. The method of claim 43, further comprising automating the movement of the first member and automating the injecting step in accordance with an algorithm.

53. The method of claim 52, wherein the algorithm assesses whether a sufficient quantity of tobacco has been compressed in the compression chamber.

54. The method of claim 53, wherein the algorithm provides for additional metering by the first member if an insufficient quantity of tobacco has been assessed.

55. The method of claim 43, wherein the first member is moveable along a first axis, and wherein the tobacco is injected along a second axis, and wherein the first and second axes are orthogonal to each other.

56. The method of claim 43, wherein the compression chamber is essentially cylindrical and has a gap on its upper surface, and wherein the first member has an edge which interfaces with the compression chamber at the gap.

57. The method of claim 56, wherein the edge of the first member is semicircular.

58. A method for filling a cigarette tube with tobacco, comprising not necessarily in sequence:

metering loose tobacco from a hopper to a compression chamber;

compressing the loose tobacco in the compression chamber; and injecting the compressed tobacco from the compression chamber to a cigarette tube in communication with the compression chamber, wherein the metering, compression, and injection steps are automated in accordance with an algorithm.

59. The method of claim 58, further comprising assessing the status of a first switch during compression to determine whether a sufficient quantity of tobacco has been compressed in the compression chamber.

60. The method of claim 59, further comprising assessing the status of a second switch to determine whether the compression is complete.

61. The method of claim 60, further comprising querying the first switch only after the second switch has been engaged.

62. The method of claim 58, wherein the automation comprises control of a metering motor, a compression motor, and an injection motor.

63. The method of claim 62, wherein compression is performed by a compression member moveable along a first axis, and wherein the compression memeber is coupled to the compression motor by a spring which allows the position of the compression member to vary along the first axis in response to a load provided by compressing the tobacco.

64. The method of claim 63, wherein the variance in the position of the compression member in response to the load selectively changes the status of a first switch.

65. The method of claim 64, further comprising assessing the status of a second switch to determine whether the compression is complete.

66. The method of claim 65, further comprising querying the first switch only after the second switch has been engaged.

67. The method of claim 58, further comprising determining whether a sufficient quantity of tobacco has been compressed in the compression chamber.

68. The method of claim 58, wherein the metering and compression steps are performed in alternating fashion prior to the injection step.

69. The method of claim 58, further comprising determining whether a sufficient quantity of tobacco has been compressed in the compression chamber during each compression step.

70. The method of claim 58, wherein the algorithm further assesses whether a sufficient quantity of tobacco has been compressed in the compression chamber.

71. The method of claim 70, wherein the algorithm provides for an additional metering step if an insufficient quantity of tobacco has been assessed.

72. The method of claim 58, wherein the metering step comprises reciprocation of a metering member through a plurality of strokes.

73. The method of claim 72, wherein the metering member is moveable by a motor.

74. The method of claim 58, wherein the tobacco is metered along a first axis, the tobacco is compressed along a second axis, and the tobacco is injected along a third axis, and wherein the first, second, and third axes are all orthogonal to each other.

75. The method of claim 58, wherein the compression step further comprises affixing the cigarette tube in communication with the compression chamber.

76. The method of claim 58, further comprising biasing the loose tobacco downward in the hopper.

77. The method of claim 58, wherein the metering and compression steps are both performed using a first member.

78. The method of claim 77, further comprising assessing the status of a first switch during compression to determine whether a sufficient quantity of tobacco has been compressed in the compression chamber.

79. The method of claim 78, further comprising assessing the status of a second switch to determine whether the compression is complete.

80. The method of claim 79, further comprising querying the first switch only after the second switch has been engaged.

81. The method of claim 77, wherein compression is performed by the first member moving along a first axis, and wherein the first member is coupled to a motor by a spring which allows the position of the first member to vary along the first axis in response to a load provided compressing the tobacco.

82. The method of claim 81, wherein the variance in the position of the first member in response to the load selectively changes the status of a first switch.

83. The method of claim 82, further comprising assessing the status of a second switch to determine whether the compression is complete.

84. The method of claim 83, further comprising querying the first switch only after the second switch has been engaged.

85. The method of claim 77, further comprising determining whether a sufficient quantity of tobacco has been compressed in the compression chamber.

86. The method of claim 77, further comprising reciprocating the first member through a plurality of strokes.

87. The method of claim 77, wherein the algorithm assesses whether a sufficient quantity of tobacco has been compressed in the compression chamber.

88. The method of claim 87, wherein the algorithm provides for additional metering by the first member if an insufficient quantity of tobacco has been assessed.

89. The method of claim 77, wherein the first member is moveable along a first axis, and wherein the tobacco is injected along a second axis, and wherein the first and second axes are orthogonal to each other.

90. The method of claim 77, wherein the compression chamber is essentially cylindrical and has a gap on its upper surface, and wherein the first member has an edge which interfaces with the compression chamber at the gap.

91. The method of claim 90, wherein the edge of the first member is semicircular.

92. The method of claim 58, wherein the tobacco is injected only after verification that the compressed tobacco in the compression chamber is of a suitable quantity.

93. A method for filling a cigarette tube with tobacco, comprising not necessarily in sequence:

metering loose tobacco from a hopper to a compression chamber;

compressing the loose tobacco in the compression chamber; and injecting the compressed tobacco from the compression chamber to a cigarette tube in communication with the compression chamber, wherein the metering step is automated, and wherein the compression and injection steps are manual.

94. The method of claim 93, further comprising determining whether a sufficient quantity of tobacco has been compressed in the compression chamber.

95. The method of claim 93, further comprising automating the metering step in accordance with an algorithm.

96. The method of claim 95, wherein the algorithm provides for an additional metering step if an insufficient quantity of tobacco has been assessed.

97. The method of claim 93, wherein the compression and injection steps comprise rotating a crank arm.

98. The method of claim 97, wherein rotating the crank arm performs the compression step before the injection step.

99. The method of claim 93, wherein the metering step comprises reciprocation of a metering member through a plurality of strokes.

100. The method of claim 99, wherein the metering member is moveable by a motor.

101. The method of claim 93, wherein the tobacco is metered along a first axis, the tobacco is compressed along a second axis, and the tobacco is injected along a third axis, and wherein the first, second, and third axes are all orthogonal to each other.

102. The method of claim 93, further comprising biasing the loose tobacco downward in the hopper.

103. A method for filling a cigarette tube with tobacco, comprising not necessarily in sequence:

metering loose tobacco from a hopper to a compression chamber by reciprocating a metering member through a plurality of strokes by rotating a crank arm;

compressing the loose tobacco in the compression chamber; and injecting the compressed tobacco from the compression chamber to a cigarette tube in communication with the compression chamber.

104. The method of claim 103, further comprising assessing the status of a first switch during compression to determine whether a sufficient quantity of tobacco has been compressed in the compression chamber.

105. The method of claim 104, further comprising assessing the status of a second switch to determine whether the compression is complete.

106. The method of claim 105, further comprising querying the first switch only after the second switch has been engaged.

107. The method of claim 103, further comprising determining whether a sufficient quantity of tobacco has been compressed in the compression chamber.

108. The method of claim 103, wherein the metering and compression steps are performed in alternating fashion prior to the injection step.

109. The method of claim 103, further comprising determining whether a sufficient quantity of tobacco has been compressed in the compression chamber during each compression step.

110. The method of claim 103, further comprising automating the compression and injecting steps in accordance with an algorithm.

111. The method of claim 110, wherein the algorithm further assesses whether a sufficient quantity of tobacco has been compressed in the compression chamber.

112. The method of claim 103, wherein the compression and injection steps are manual.

113. The method of claim 112, wherein the compression and injection steps comprise rotating a crank arm.

114. The method of claim 103, wherein the tobacco is metered along a first axis, the tobacco is compressed along a second axis, and the tobacco is injected along a third axis, and wherein the first, second, and third axes are all orthogonal to each other.

115. The method of claim 103, further comprising biasing the loose tobacco downward in the hopper.

116. A method for filling a cigarette tube with tobacco, comprising not necessarily in sequence:

metering loose tobacco from a hopper to a compression chamber;

compressing the loose tobacco in the compression chamber; and injecting the compressed tobacco from the compression chamber to a cigarette tube in communication with the compression chamber, wherein the tobacco is metered along a first axis, the tobacco is compressed along a second axis, and the tobacco is injected along a third axis, and wherein the first, second, and third axes are all orthogonal to each other.

117. The method of claim 116, further comprising assessing the status of a first switch during compression to determine whether a sufficient quantity of tobacco has been compressed in the compression chamber.

118. The method of claim 117, further comprising assessing the status of a second switch to determine whether the compression is complete.

119. The method of claim 118, further comprising querying the first switch only after the second switch has been engaged.

120. The method of claim 116, wherein the metering, compressing, and injecting steps are respectively automated by a metering motor, a compression motor, and an injection motor.

121. The method of claim 120, wherein compression is performed by a compression member moveable along a first axis, and wherein the compression member is coupled to the compression motor by a spring which allows the position of the compression member to vary along the first axis in response to a load provided by compressing the tobacco.

122. The method of claim 121, wherein the variance in the position of the compression member in response to the load selectively changes the status of a first switch.

123. The method of claim 122, further comprising assessing the status of a second switch to determine whether the compression is complete.

124. The method of claim 123, further comprising querying the first switch only after the second switch has been engaged.

125. The method of claim 116, further comprising determining whether a sufficient quantity of tobacco has been compressed in the compression chamber.

126. The method of claim 116, wherein the metering and compression steps are performed in alternating fashion prior to the injection step.

127. The method of claim 116, further comprising determining whether a sufficient quantity of tobacco has been compressed in the compression chamber during each compression step.

128. The method of claim 116, further comprising automating the metering compression, and injecting steps in accordance with an algorithm.

129. The method of claim 128, wherein the algorithm further assesses whether a sufficient quantity of tobacco has been compressed in the compression chamber.

130. The method of claim 129, wherein the algorithm provides for an additional metering step if an insufficient quantity of tobacco has been assessed.

131. The method of claim 116, wherein the metering step is automated.

132. The method of claim 131, wherein the compression and injection steps are manual.

133. The method of claim 132, wherein the compression and injection steps comprise rotating a crank arm.

134. The method of claim 116, wherein the metering, compression, and injection steps are manual.

135. The method of claim 116, wherein the metering step comprises reciprocation of a metering member through a plurality of strokes.

136. The method of claim 135, wherein the metering member is moveable by a motor.

137. The method of claim 116, further comprising, prior to the metering, compression, and injection steps, affixing the cigarette tube in communication with the compression chamber.

138. The method of claim 116, further comprising biasing the loose tobacco downward in the hopper.

139. The method of claim 116, wherein the tobacco is injected only after verification that the compressed tobacco in the compression chamber is of a suitable quantity.

140. A method for filling a cigarette tube with tobacco, comprising not necessarily in sequence:

metering loose tobacco from a hopper to a compression chamber;

compressing the loose tobacco in the compression chamber; and injecting the compressed tobacco from the compression chamber to a cigarette tube in communication with the compression chamber, wherein the metering and compression steps are both performed using a first member.

141. The method of claim 140, further comprising assessing the status of a first switch during compression to determine whether a sufficient quantity of tobacco has been compressed in the compression chamber.

142. The method of claim 141, further comprising assessing the status of a second switch to determine whether the compression is complete.

143. The method of claim 142, further comprising querying the first switch only after the second switch has been engaged.

144. The methodof claim 140, wherein the method is automated using a metering/ compression motor and an injection motor.

145. The method of claim 144, wherein compression is performed by the first member moveable along a first axis, and wherein the compression member is coupled to the metering/compression motor by a spring which allows the position of the compression member to vary along the first axis in response to a load provided by compressing the tobacco.

146. The method of claim 145, wherein the variance in the position of the compression member in response to the load selectively changes the status of a first switch.

147. The method of claim 146, further comprising assessing the status of a second switch to determine whether the compression is complete.

148. The method of claim 147, further comprising querying the first switch only after the second switch has been engaged.

149. The method of claim 140, further comprising determining whether a sufficient quantity of tobacco has been compressed in the compression chamber.

150. The method of claim 140, further comprising determining whether a sufficient quantity of tobacco has been compressed in the compression chamber during each compression step.

151. The method of claim 140, further comprising automating the movement of the first member and automating the injecting step in accordance with an algorithm.

152. The method of claim 151, wherein the algorithm further assesses whether a sufficient quantity of tobacco has been compressed in the compression chamber.

153. The method of claim 152, wherein the algorithm provides for an additional metering step if an insufficient quantity of tobacco has been assessed.

154. The method of claim 140, wherein the metering step comprises reciprocation of the first member through a plurality of strokes.

155. The method of claim 154, wherein the first member is moveable by a motor.

156. The method of claim 140, further comprising, prior to the metering, compression, and injection steps, affixing the cigarette tube in communication with the compression chamber.

157. The method of claim 140, further comprising biasing the loose tobacco downward in the hopper.

158. The method of claim 140, further comprising automating the movement of the first member and automating the injection step.

159. The method of claim 140, further comprising reciprocating the first member through a plurality of strokes.

160. The method of claim 140, wherein the first member and injection member are manually moveable.

161. The method of claim 140, wherein the first member is moveable along a first axis, and wherein the tobacco is injected along a second axis, and wherein the first and second axes are orthogonal to each other.

162. The method of claim 140, wherein the compression chamber is essentially cylindrical and has a gap on its upper surface, and wherein the first member has an edge which interfaces with the compression chamber at the gap.

163. The method of claim 162, wherein the edge of the first member is semicircular.

164. The method of claim 140, wherein the tobacco is injected only after verification that the compressed tobacco in the compression chamber is of a suitable quantity.

165. A method for filling a cigarette tube with tobacco, comprising not necessarily in sequence:

metering loose tobacco from a hopper to a compression chamber by reciprocating a first member through a plurality of strokes along an axis;

compressing the loose tobacco in the compression chamber; and injecting the compressed tobacco from the compression chamber to a cigarette tube in communication with the compression chamber.

166. The method of claim 165, further comprising assessing the status of a first switch during compression to determine whether a sufficient quantity of tobacco has been compressed in the compression chamber.

167. The method of claim 167, further comprising querying the first switch only after the second switch has been engaged.

168. The method of claim 167, further comprising querying the first switch only after the second switch has been engaged.

169. The method of claim 165, wherein the metering, compressing, and injecting steps are respectively automated by a metering motor, a compression motor, and an injection motor.

170. The method of claim 169, wherein compression is performed by a compression member movable along a first axis, and wherein the compression member is coupled to the compression motor by a spring which allows the position of the compression member to vary along the first axis in response to a load provided by compressing the tobacco.

171. The method of claim 170, wherein the variance in the position of the compression member in response to the load selectively changes the status of a first switch.

172. The method of claim 171, further comprising assessing the status of a second switch to determine whether the compression is complete.

173. The method of claim 172, further comprising querying the first switch only after the second switch has been engaged.

174. The method of claim 165, further comprising determining whether a sufficient quantity of tobacco has been compressed in the compression chamber.

175. The method of claim 165, wherein the metering and compression steps are performed in alternating fashion prior to the injection step.

176. The method of claim 163, further comprising determining whether a sufficient quantity of tobacco has been compressed in the compression chamber during each compression step.

177. The method of claim 163, further comprising automating the metering, compression, and injecting step in accordance with an algorithm.

178. The method of claim 177, wherein the algorithm further assesses whether a sufficient quantity of tobacco has been compressed in the compression chamber.

179. The method of claim 178, wherein the algorithm provides for an additional metering step if an insufficient quantity of tobacco has been assessed.

180. The method of claim 165, wherein the metering step is automated.

181. The method of claim 180, wherein the compression and injection steps are manual.

182. The method of claim 181, wherein the compression and injection steps comprise rotating a crank arm.

183. The method of claim 182, wherein rotating the crank arm performs the compression step before the injection step.

184. The method of claim 165, wherein the metering, compression, and injection steps are manual.

185. The method of claim 184, wherein the compression and injection steps comprise rotating a crank arm.

186. The method of claim 185, wherein rotating the crank arm performs the compression step before the injection step.

187. The method of claim 165, wherein the metering step comprises reciprocation of the first member through the plurality of strokes, and wherein the compression step is performed by a second member.

188. The method of claim 187, wherein the first member is moveable by a motor.

189. The method of claim 187, wherein the first member is moveable by a rotating crank arm.

190. The method of claim 165, wherein the tobacco is metered along a first axis, the tobacco is compressed along a second axis, and the tobacco is injected along a third axis, and wherein the first, second, and third axes are all orthogonal to each other.

191. The method of claim 165, wherein the compression step further comprises affixing the cigarette tube in communication with the compression chamber.

192. The method of claim 165, further comprising, prior to the metering, compression, and injection steps, affixing the cigarette tube in communication with the compression chamber.

193. The method of claim 165, further comprising biasing the loose tobacco downward in the hopper.

194. The method of claim 165, wherein the metering and compression steps are both performed using the first member.

195. The method of claim 194, further comprising assessing the status of a first switch during compression to determining whether a sufficient quantity of tobacco has been compressed in the compression chamber.

196. The method of claim 195, further comprising assessing the status of a second switch to determining whether the compression is complete.

197. The method of claim 196, further comprising querying the first switch only after the second switch has been engaged.

198. The method of claim 194, further comprising automating the movement of the first member and automating the injection step.

199. The method of claim 198, wherein compression is performed by a compression member moving along a first axis, and wherein the first member is coupled to a motor by a spring which allows the position of the first member to vary along the first axis in response to a load provided compressing the tobacco.

200. The method of claim 199, wherein the variance in the position of the first member in response to the load selectively changes the status of a first

201. The method of claim 200, further comprising assessing the status of a second switch to determine whether the compression is complete.

202. The method of claim 201, further comprising querying the first switch only after the second switch has been engaged.

203. The method of claim 195, further comprising determining whether a sufficient quantity of tobacco has been compressed in the compression chamber.

204. The method of claim 194, further comprising automating the movement of the first member and automating the injecting step in accordance with an algorithm.

205. The method of claim 204, wherein the algorithm assesses whether a sufficient quantity of tobacco has been compressed in the compression chamber.

206. The method of claim 205, wherein the algorithm provides for additional metering by the first member if an insufficient quantity of tobacco has been assessed.

207. The method of claim 194, wherein the first member and injection member are manually moveable.

208. The method of claim 194, wherein the first member is moveable along a first axis, and wherein the tobacco is injected along a second axis, and wherein the first and second axes are orthogonal to each other.

209. The method of claim 194, further comprising biasing the loose tobacco downward in the hopper.

210. The method of claim 194, wherein the compression chamber is essentially cylindrical and has a gap on its upper surface, and wherein the first member has an edge which interfaces with the compression chamber at the gap.

211. The method of claim 210, wherein the edge of the first member is semicircular.

212. The method of claim 165, wherein the tobacco is injected only after verification that the compressed tobacco in the compression chamber is of a suitable quantity.

* * * * *

UNITED STATES PATENT AND TRADEMARK OFFICE

CERTIFICATE OF CORRECTION

PATENT NO. : 6,913,022 B2
DATED : July 5, 2005
INVENTOR(S) : Larry E. Moser and Robert J. Daily It is certified that error appears in the above-identified patent and that said Letters Patent is hereby corrected as shown below:

Column 21,
Line 66, replace “determining” with -- determine --.

Column 24,
Beginning at line 13, replace “recrip-rocating” with -- reciprocating --.
Line 41, replace “injection” with -- injecting --.
Line 58, replace “memeber” with -- member --.

Column 29,
Line 1, replace “methodof” with -- method of --.

Column 31,
Lines 30 and 33, replace “determining” with -- determine --.

Column 32,
Line 6, insert -- switch. -- after “first”.

Signed and Sealed this

Thirtieth Day of August, 2005

JON W. DUDAS
*Director of the United States Patent and Trademark Office*